US008465129B2

(12) United States Patent
Panchawagh et al.

(10) Patent No.: US 8,465,129 B2
(45) Date of Patent: Jun. 18, 2013

(54) LIQUID EJECTION USING DROP CHARGE AND MASS

(75) Inventors: Hrishikesh V. Panchawagh, Rochester, NY (US); Michael A. Marcus, Honeoye Falls, NY (US); James A. Katerberg, Kettering, OH (US)

(73) Assignee: Eastman Kodak Company, Rochester, NY (US)

( * ) Notice: Subject to any disclaimer, the term of this patent is extended or adjusted under 35 U.S.C. 154(b) by 118 days.

(21) Appl. No.: 13/115,421

(22) Filed: May 25, 2011

(65) Prior Publication Data

US 2012/0299998 A1 Nov. 29, 2012

(51) Int. Cl.
*B41J 2/085* (2006.01)

(52) U.S. Cl.
USPC ..... 347/76

(58) Field of Classification Search
USPC ..... 347/73–82, 90
See application file for complete search history.

(56) References Cited

U.S. PATENT DOCUMENTS

| | | | | |
|---|---|---|---|---|
| 3,373,437 | A | 3/1968 | Sweet et al. | |
| 3,596,275 | A | 7/1971 | Sweet | |
| 4,068,241 | A | 1/1978 | Yamada | |
| 6,079,821 | A | 6/2000 | Chwalek et al. | |
| 6,235,212 | B1 | 5/2001 | Silverbrook | |
| 6,273,559 | B1 | 8/2001 | Vago et al. | |
| 6,312,110 | B1 | 11/2001 | Darty | |
| 6,450,619 | B1 | 9/2002 | Anagnostopoulos et al. | |
| 6,450,628 | B1 * | 9/2002 | Jeanmaire et al. | 347/75 |
| 6,505,922 | B2 | 1/2003 | Hawkins et al. | |
| 6,509,917 | B1 | 1/2003 | Chwalek et al. | |
| 6,554,410 | B2 | 4/2003 | Jeanmaire et al. | |
| 6,588,888 | B2 | 7/2003 | Jeanmaire et al. | |
| 6,663,221 | B2 | 12/2003 | Anagnostopoulos et al. | |
| 6,746,108 | B1 * | 6/2004 | Jeanmaire | 347/82 |
| 6,793,328 | B2 * | 9/2004 | Jeanmaire | 347/74 |
| 6,827,429 | B2 * | 12/2004 | Jeanmaire et al. | 347/77 |
| 6,851,796 | B2 * | 2/2005 | Jeanmaire et al. | 347/74 |
| 7,192,121 | B2 | 3/2007 | Barbet et al. | |
| 7,364,276 | B2 | 4/2008 | Piatt et al. | |
| 7,712,879 | B2 | 5/2010 | Barbet | |
| 7,938,516 | B2 | 5/2011 | Piatt et al. | |
| 8,091,983 | B2 * | 1/2012 | Xie et al. | 347/77 |
| 8,104,878 | B2 | 1/2012 | Montz et al. | |
| 2006/0139408 | A1 | 6/2006 | Barbet et al. | |
| 2009/0153627 | A1 | 6/2009 | Barbet | |
| 2009/0225112 | A1 | 9/2009 | Barbet | |
| 2009/0231398 | A1 | 9/2009 | Barbet | |
| 2010/0033542 | A1 | 2/2010 | Piatt et al. | |

* cited by examiner

*Primary Examiner* — Kristal Feggins
(74) *Attorney, Agent, or Firm* — William R. Zimmerli

(57) ABSTRACT

A liquid ejection system ejects a liquid jet through a nozzle. A drop formation device modulates the jet causing portions to break off into drop pairs, including first and second drops, separated on average by a drop pair period, and modulates the jet to cause portions to break off into larger third drops separated on average by the same period. A charging device includes a varying electrical potential source providing a waveform including first and second distinct voltage states and a period equal to the drop formation period. The charging device and the formation device are synchronized to produce first, second, and third charge to mass ratios on the first, second, and third drops, respectively. A deflection device causes the first, second, and third drops to travel along first, second, and third paths, respectively. The first and third charge to mass ratios and paths are substantially the same.

21 Claims, 17 Drawing Sheets

LIQUID EJECTION USING DROP CHARGE AND MASS

CROSS REFERENCE TO RELATED APPLICATIONS

Reference is made to commonly-assigned, U.S. patent application Ser. No. 13/115,434, entitled "EJECTING LIQUID USING DROP CHARGE AND MASS" filed concurrently herewith.

FIELD OF THE INVENTION

This invention relates generally to the field of digitally controlled printing systems, and in particular to continuous printing systems in which a liquid stream breaks into drops some of which are electrostatically deflected.

BACKGROUND OF THE INVENTION

Ink jet printing has become recognized as a prominent contender in the digitally controlled, electronic printing arena because, e.g., of its non-impact, low-noise characteristics, its use of plain paper and its avoidance of toner transfer and fixing. Ink jet printing mechanisms can be categorized by technology as either drop on demand ink jet (DOD) or continuous ink jet (CIJ).

The first technology, "drop-on-demand" ink jet printing, provides ink drops that impact upon a recording surface by using a pressurization actuator (thermal, piezoelectric, etc.). One commonly practiced drop-on-demand technology uses thermal actuation to eject ink drops from a nozzle. A heater, located at or near the nozzle, heats the ink sufficiently to boil, forming a vapor bubble that creates enough internal pressure to eject an ink drop. This form of inkjet is commonly termed "thermal ink jet (TIJ)."

The second technology commonly referred to as "continuous" ink jet (CIJ) printing, uses a pressurized ink source to produce a continuous liquid jet stream of ink by forcing ink, under pressure, through a nozzle. The stream of ink may be perturbed in a manner such that the liquid jet breaks up into drops of ink in a predictable manner. Printing occurs through the selective deflecting and catching of undesired ink drops. Various approaches for selectively deflecting drops have been developed including the use of electrostatic deflection, air deflection and thermal deflection mechanisms.

In a first electrostatic deflection based CIJ approach, the liquid jet stream is perturbed in some fashion causing it to break up into uniformly sized drops at a nominally constant distance, the break-off length, from the nozzle. A charging electrode structure is positioned at the nominally constant break-off point so as to induce a data-dependent amount of electrical charge on the drop at the moment of break-off. The charged drops are then directed through a fixed electrostatic field region causing each droplet to deflect proportionately to its charge. The charge levels established at the break-off point thereby cause drops to travel to a specific location on a recording medium or to a gutter, commonly called a catcher, for collection and recirculation. This approach is disclosed by R. Sweet in U.S. Pat. No. 3,596,275 issued Jul. 27, 1971, Sweet '275 hereinafter. The CIJ apparatus disclosed by Sweet '275 consisted of a single jet, i.e. a single drop generation liquid chamber and a single nozzle structure. A disclosure of a multi-jet CIJ printhead version utilizing this approach has also been made by Sweet et al. in U.S. Pat. No. 3,373,437 issued Mar. 12, 1968, Sweet '437 hereinafter. Sweet '437 discloses a CIJ printhead having a common drop generator chamber that communicates with a row (an array) of drop emitting nozzles each with its own charging electrode. This approach requires that each nozzle have its own charging electrode, with each of the individual electrodes being supplied with an electric waveform that depends on the image data to be printed. This requirement for individually addressable charge electrodes places limits on the fundamental nozzle spacing and therefore on the resolution of the printing system.

A second electrostatic deflection based CIJ approach is disclosed by Vago et al. in U.S. Pat. No. 6,273,559 issued Aug. 14, 2001, Vago '559 hereinafter. Vago '559 discloses a binary CIJ technique in which electrically conducting ink is pressurized and discharged through a calibrated nozzle and the liquid ink jets formed are broken off at two different time intervals. Drops to be printed or not printed are created with periodic stimulation pulses at a nozzle. The drops to be printed are each created with a periodic stimulation pulse that is relatively strong and causes the ink jet stream forming the drops to be printed to separate at a relatively short break off length. The drops that are not to be printed are each created with a periodic stimulation pulse that is relatively weak and causes the drop to separate at a relatively long break off length. Two sets of closely spaced electrodes with different applied DC electric potentials are positioned just downstream of the nozzle adjacent to the two break off locations and provide distinct charge levels to the relatively short break off length drops and the relatively long break off length drops as they are formed. The longer break off length drops are selectively deviated from their path by a deflection device because of their charge and are deflected by the deflection device towards a catcher surface where they are collected in a gutter and returned to a reservoir for reuse. Vago '559 also requires that the difference in break off lengths between the relatively short break off and the relatively long break off length be less than a wavelength ($\lambda$) that is the distance between successive ink drops or ink nodes in the liquid jet. This requires two stimulation amplitudes (print and non-print stimulation amplitudes) to be employed. Limiting the break off length locations difference to less than $\lambda$ restricts the stimulation amplitudes difference that must be used to a small amount. For a printhead that has only a single jet, it is quite easy to adjust the position of the electrodes, the voltages on the charging electrodes, and print and non-print stimulation amplitudes to produce the desired separation of print and non-print droplets. However, in a printhead having an array of nozzles parts tolerances can make this quite difficult. The need to have a high electric field gradient in the droplet break off region makes the drop selection system sensitive to slight variations in charging electrode flatness, electrode thicknesses, and electrode to jet distances that can all produce variations in the electric field strength and the electric field gradient at the droplet break off region for the different liquid jets in the array. In addition, the droplet generator and the associated stimulation devices may not be perfectly uniform down the nozzle array, and may require different stimulation amplitudes from nozzle to nozzle to produce particular break off lengths. These problems are compounded by ink properties that drift over time, and thermal expansion that can cause the charging electrodes to shift and warp with temperature. In such systems, extra control complexity is required to adjust the print and non-print stimulation amplitudes from nozzle to nozzle to ensure the desired separation of print and non-print droplets. B. Barbet and P. Henon also disclose utilizing break off length variation to control printing in U.S. Pat. No. 7,192,121 issued Mar. 20, 2007.

B. Barbet in U.S. Pat. No. 7,712,879 issued May 11, 2010 discloses an electrostatic charging and deflection mechanism based on break off length and drop size. A split common charging electrode with a DC low voltage on the top section and a DC high voltage on the lower segment is utilized to differentially charge small drops and large drops according to their diameter.

T. Yamada in U.S. Pat. No. 4,068,241 issued Jan. 10, 1978, Yamada '241 hereinafter, discloses an inkjet recording device which alternately produces large drops and small drops. All drops are charged with a DC electrostatic field in the break off region of the liquid jet. Yamada '241 also changes the excitation drop magnitude of small drops not necessary for recording so that they will collide and combine with the large drops. Large drops and large drops combined with small drops are guttered and not printed while deflected small drops are printed. One of the disadvantages of this approach is that deflected drops are printed which could result in drop placement errors. This approach is very sensitive to small changes in stimulation amplitude and to small changes in ink properties. Furthermore, as the smaller drop needs to be much smaller than the larger drop in order to be able create different charge states on each; higher nozzle diameter nozzles are required for producing the desired sizes of print drops. This limits the density of nozzle spacing that can be utilized in such an approach and severely limits the capability to print high resolution images.

As such, there is an ongoing need to provide a continuous printing system that electrostatically deflects selected drops, is tolerant of drop break off length, has a simplified design, and yields improved print quality.

SUMMARY OF THE INVENTION

It is an object of the invention to overcome at least one of the deficiencies described above by using mass charging and electrostatic deflection with a CMOS-MEMS printhead to create high resolution high quality prints while maintaining or improving drop placement accuracy and minimizing drop volume variation of printed drops.

Image data dependent control of drop formation via break off of each of the liquid jets and a charge electrode that has a image data independent time varying electrical potential, called a charge electrode waveform, are provided by the present invention. Drop formation is controlled to create a pair of drops including a first drop and a second drop, or create a third drop using drop formation waveforms supplied to a drop formation device. The third drop is larger (in size or volume) when compared to the first drop and the second drop of the drop pair. The charge electrode waveform and the drop formation waveforms are synchronized to alternately charge the first drop in the drop pair to a first charge to mass ratio and the second drop in the drop pair to a second charge to mass ratio or to charge the larger third drop into a third charge to mass ratio state.

The present invention helps to provide system robustness by allowing larger tolerances on break-off time variations between jets in a long nozzle array. Additionally, at least every other drop is collected by a catcher helping to ensure that liquid remains on the catcher which reduces the likelihood of liquid splatter during operation. The present invention reduces the complexity of control of signals sent to stimulation devices associated with nozzles of the nozzle array. This helps to reduce the complexity of charge electrode structures and increase spacing between the charge electrode structures and the nozzles.

According to an aspect of the invention, a continuous liquid ejection system is provided. The system includes a liquid chamber in fluidic communication with a nozzle. The liquid chamber contains liquid under pressure sufficient to eject a liquid jet through the nozzle. A drop formation device is associated with the liquid jet. The drop forming device is actuatable to produce a modulation in the liquid jet to selectively cause portions of the liquid jet to break off into one or more pairs of drops traveling along a path. Each drop pair is separated on average by a drop pair period. Each drop pair includes a first drop and a second drop. The drop formation device is also actuatable to produce a modulation in the liquid jet to selectively cause portions of the liquid jet to break off into one or more third drops traveling along the path separated on average by the same drop pair period. The third drop is larger than the first drop and the second drop. A charging device includes a charge electrode associated with the liquid jet and a source of varying electrical potential between the charge electrode and the liquid jet. The source of varying electrical potential provides a waveform that includes a period that is equal to the period of formation of the drop pairs or the third drops, the drop pair period. The waveform also includes a first distinct voltage state and a second distinct voltage state. The charging device and the drop formation device are synchronized to produce a first charge to mass ratio on the first drop of the drop pair, a second charge to mass ratio on the second drop of the drop pair, and a third charge to mass ratio on the third drop. The third charge to mass ratio is substantially the same as the first charge to mass ratio. A deflection device causes the first drop of the drop pair having the first charge to mass ratio to travel along a first path, and causes the second drop of the drop pair having the second charge to mass ratio to travel along a second path, and causes the third drop having a third charge to mass ratio to travel along a third path. The third path is substantially the same as the first path.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

Figure 1:
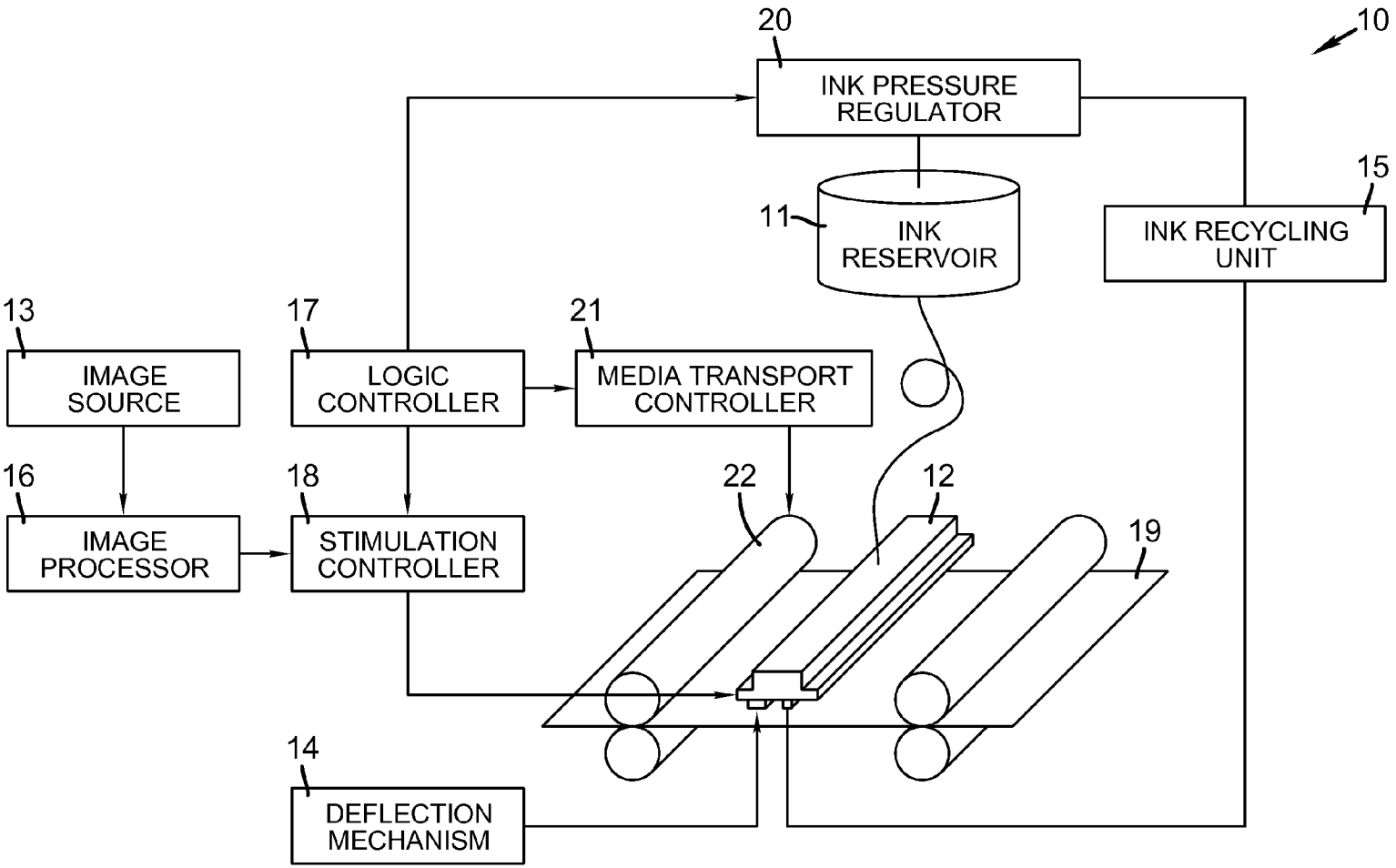
FIG. 1 is a simplified block schematic diagram of an exemplary continuous inkjet system according to the present invention.

The present description will be directed in particular to elements forming part of, or cooperating more directly with, apparatus in accordance with the present invention. It is to be understood that elements not specifically shown or described may take various forms well known to those skilled in the art. In the following description and drawings, identical reference numerals have been used, where possible, to designate identical elements.

The example embodiments of the present invention are illustrated schematically and not to scale for the sake of clarity. One of the ordinary skills in the art will be able to readily determine the specific size and interconnections of the elements of the example embodiments of the present invention.

As described herein, example embodiments of the present invention provide a printhead or printhead components typically used in inkjet printing systems. In such systems, the liquid is an ink for printing on a recording media. However, other applications are emerging, which use inkjet print heads to emit liquids (other than inks) that need to be finely metered and be deposited with high spatial resolution. As such, as described herein, the terms "liquid" and "ink" refer to any material that can be ejected by the printhead or printhead components described below.

Continuous ink jet (CIJ) drop generators rely on the physics of an unconstrained fluid jet, first analyzed in two dimensions by F. R. S. (Lord) Rayleigh, "Instability of jets," Proc. London Math. Soc. 10 (4), published in 1878. Lord Rayleigh's analysis showed that liquid under pressure, P, will stream out of a hole, the nozzle, forming a liquid jet of diameter $d_j$, moving at a velocity $v_j$. The jet diameter $d_j$ is approximately equal to the effective nozzle diameter dn and the jet velocity is proportional to the square root of the reservoir pressure P. Rayleigh's analysis showed that the jet will naturally break up into drops of varying sizes based on surface waves that have wavelengths $\lambda$ longer than $\pi d_j$, i.e. $\lambda \geqq \pi d_j$. Rayleigh's analysis also showed that particular surface wavelengths would become dominate if initiated at a large enough magnitude, thereby "stimulating" the jet to produce mono-sized drops. Continuous ink jet (CIJ) drop generators employ a periodic physical process, a so-called "perturbation" or "stimulation" that has the effect of establishing a particular, dominate surface wave on the jet. The stimulation results in the break off of the jet into mono-sized drops synchronized to the fundamental frequency of the perturbation. It has been shown that the maximum efficiency of jet break off occurs at an optimum frequency $F_{opt}$ which results in the shortest time to break off. At the optimum frequency $F_{opt}$ the perturbation wavelength $\lambda$ is approximately equal to $4.5d_j$. The frequency at which the perturbation wavelength $\lambda$ is equal to $\pi d_j$ is called the Rayleigh cutoff frequency $F_R$, since perturbations of the liquid jet at frequencies higher than the cutoff frequency won't grow to cause a drop to be formed.

The drop stream that results from applying Rayleigh stimulation will be referred to herein as creating a stream of drops of predetermined volume. While in prior art CIJ systems, the drops of interest for printing or patterned layer deposition were invariably of unitary volume, it will be explained that for the present inventions, the stimulation signal may be manipulated to produce drops of predetermined multiples of the unitary volume. Hence the phrase, "streams of drops of predetermined volumes" is inclusive of drop streams that are broken up into drops all having one size or streams broken up into drops of planned different volumes.

In a CIJ system, some drops, usually termed "satellites" much smaller in volume than the predetermined unit volume, may be formed as the stream necks down into a fine ligament of fluid. Such satellites may not be totally predictable or may not always merge with another drop in a predictable fashion, thereby slightly altering the volume of drops intended for printing or patterning. The presence of small, unpredictable satellite drops is, however, inconsequential to the present invention and is not considered to obviate the fact that the drop sizes have been predetermined by the synchronizing energy signals used in the present invention. Thus the phrase "predetermined volume" as used to describe the present invention should be understood to comprehend that some small variation in drop volume about a planned target value may occur due to unpredictable satellite drop formation.

The example embodiments discussed below with reference to FIGS. 1-12 are described using particular combinations of components, for example, particular combinations of drop charging structures, drop deflection structures, drop catching structures, drop forming devices, and drop velocity modulating devices. It should be understood that these components are interchangeable and that other combinations of these components are within the scope of the invention.

A continuous inkjet printing system 10 as illustrated in FIG. 1 comprises an ink reservoir 11 that continuously pumps ink into a printhead 12 also called a liquid ejector to create a continuous stream of ink drops. Printing system 10 receives digitized image process data from an image source 13 such as a scanner, computer or digital camera or other source of digital data which provides raster image data, outline image data in the form of a page description language, or other forms of digital image data. The image data from the image source 13 is sent periodically to an image processor 16. Image processor 16 processes the image data and includes a memory for storing image data. The image processor 16 is typically a raster image processor (RIP). Image data also called print data in image processor 16 that is stored in image memory in the image processor 16 is sent periodically to a stimulation controller 18 which generates patterns of time-varying electrical stimulation pulses to cause a stream of drops to form at the outlet of each of the nozzles on printhead 12, as will be described. These stimulation pulses are applied at an appropriate time and at an appropriate frequency to stimulation device(s) associated with each of the nozzles. The printhead 12 and deflection mechanism 14 work cooperatively in order to determine whether ink droplets are printed on a recording medium 19 in the appropriate position designated by the data in image memory or deflected and recycled via the ink recycling unit 15. The ink in the ink recycling unit 15 is directed back into the ink reservoir 11. The ink is distributed under pressure to the back surface of the printhead 12 by an ink channel that includes a chamber or plenum formed in a substrate typically constructed of silicon. Alternatively, the chamber could be formed in a manifold piece to which the silicon substrate is attached. The ink preferably flows from the chamber through slots and/or holes etched through the silicon substrate of the printhead 12 to its front surface, where a plurality of nozzles and stimulation devices are situated. The ink pressure suitable for optimal operation will depend on a number of factors, including geometry and thermal properties of the nozzles and thermal and fluid dynamic properties of the ink. The constant ink pressure can be achieved by applying pressure to ink reservoir 11 under the control of ink pressure regulator 20.

One well-known problem with any type inkjet printer, whether drop-on-demand or continuous ink jet, relates to the accuracy of dot positioning. As is well-known in the art of inkjet printing, one or more drops are generally desired to be placed within pixel areas (pixels) on the receiver, the pixel areas corresponding, for example, to pixels of information comprising digital images. Generally, these pixel areas comprise either a real or a hypothetical array of squares or rectangles on the receiver, and printer drops are intended to be placed in desired locations within each pixel, for example in the center of each pixel area, for simple printing schemes, or, alternatively, in multiple precise locations within each pixel areas to achieve half-toning. If the placement of the drop is incorrect and/or their placement cannot be controlled to achieve the desired placement within each pixel area, image artifacts may occur, particularly if similar types of deviations from desired locations are repeated on adjacent pixel areas. The RIP or other type of processor 16 converts the image data to a pixel-mapped image page image for printing. During printing, recording medium 19 is moved relative to printhead 12 by means of a plurality of transport rollers 22 which are electronically controlled by media transport controller 21. A logic controller 17, preferably micro-processor based and suitably programmed as is well known, provides control signals for cooperation of transport controller 21 with the ink pressure regulator 20 and stimulation controller 18. The stimulation controller 18 comprises a drop controller that provides drop forming pulses, the drive signals for ejecting individual ink drops from printhead 12 to recording medium 19, according to the image data obtained from an image memory forming part of the image processor 16. Image data may include raw image data, additional image data generated from image processing algorithms to improve the quality of printed images, and data from drop placement corrections, which can be generated from many sources, for example, from measurements of the steering errors of each nozzle in the printhead 12 as is well-known to those skilled in the art of printhead characterization and image processing. The information in the image processor 16 thus can be said to represent a general source of data for drop ejection, such as desired locations of ink droplets to be printed and identification of those droplets to be collected for recycling.

It should be appreciated that different mechanical configurations for receiver transport control can be used. For example, in the case of a page-width printhead, it is convenient to move recording medium 19 past a stationary printhead 12. On the other hand, in the case of a scanning-type printing system, it is more convenient to move a printhead along one axis (i.e., a main-scanning direction) and move the recording medium along an orthogonal axis (i.e., a sub-scanning direction), in relative raster motion.

Drop forming pulses are provided by the stimulation controller 18 which may be generally referred to as a drop controller and are typically voltage pulses sent to the printhead 12 through electrical connectors, as is well-known in the art of signal transmission. However, other types of pulses, such as optical pulses, may also be sent to printhead 12, to cause printing and non-printing drops to be formed at particular nozzles, as is well-known in the inkjet printing arts. Once formed, printing drops travel through the air to a recording medium and later impinge on a particular pixel area of the recording medium or are collected by a catcher as will be described.

Figure 2:
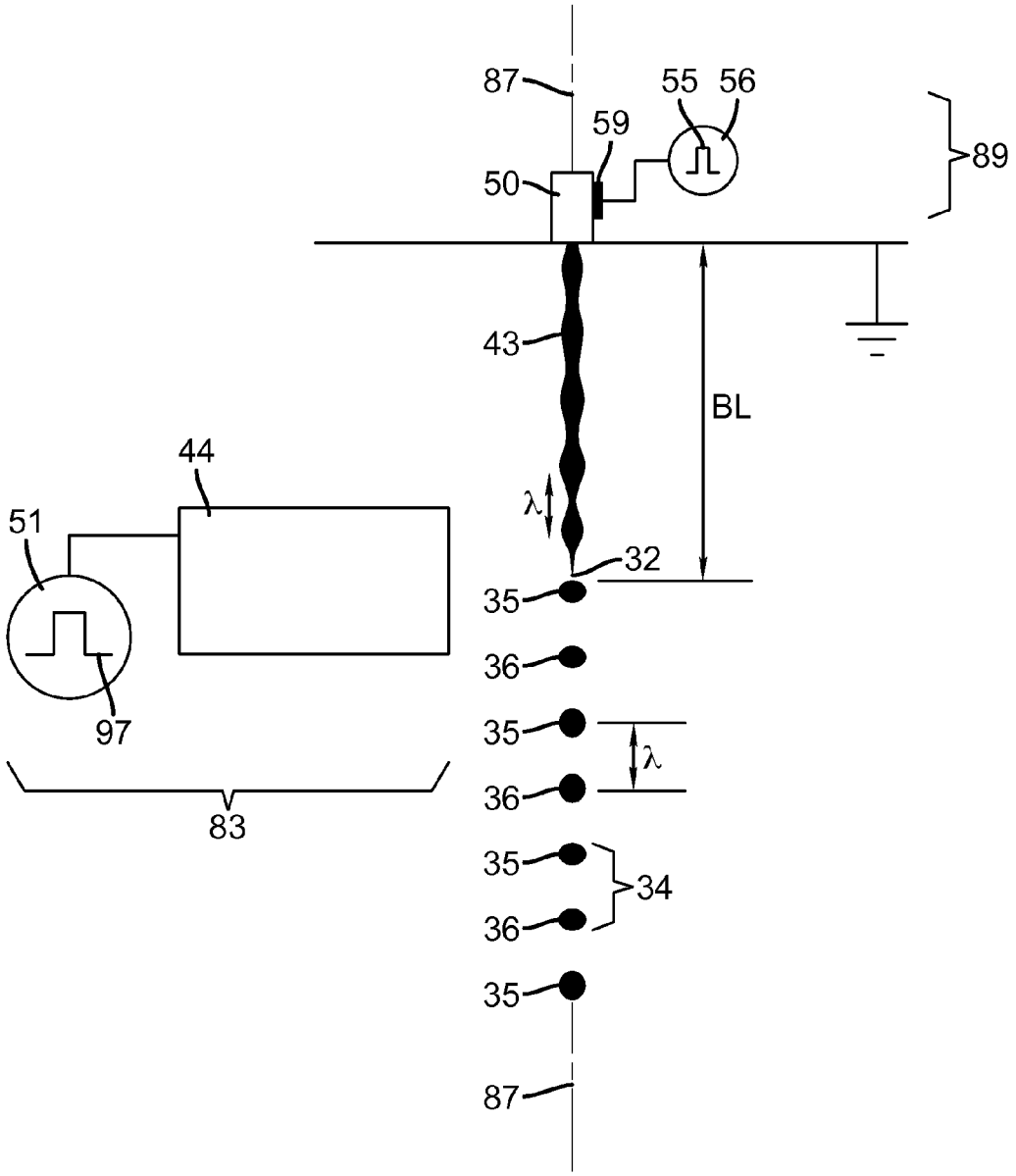
FIG. 2 shows an image of a liquid jet being ejected from a drop generator and its subsequent break off into drops with the fundamental period.
Figure 3:
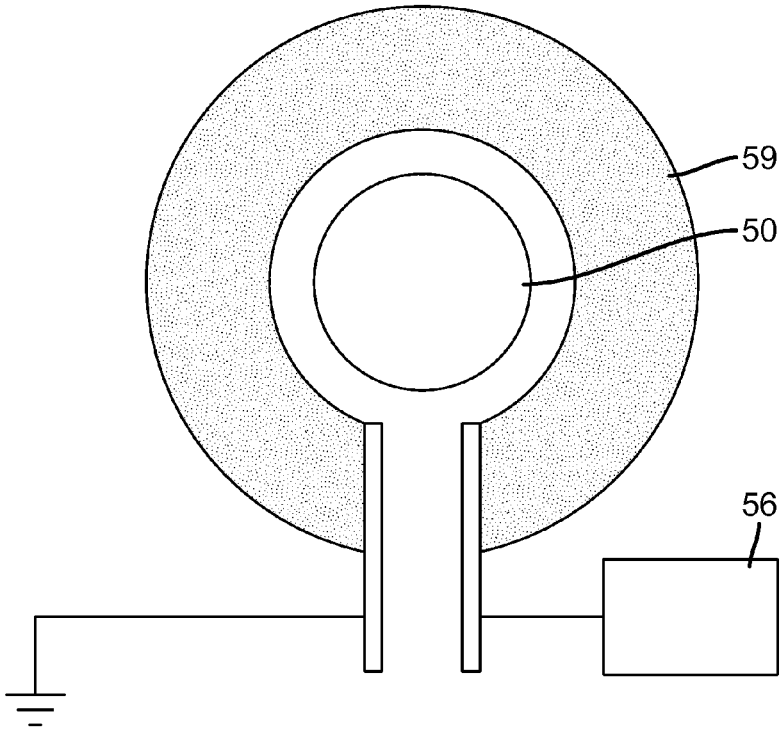
FIG. 3 is a simplified block schematic diagram of a nozzle and associated jet stimulation device according to one embodiment of the invention.

Referring to FIG. 2 the printing system has associated with it, a printhead that is operable to produce from an array of nozzles 50 an array of liquid jets 43. Associated with each liquid jet 43 is a drop formation device 89. The drop formation device includes a drop formation transducer 59 and a drop formation waveform source 56 that supplies a waveform 55, also called a drop formation waveform, to the drop formation transducer. The drop formation transducer, commonly called a stimulation transducer, can be of any type suitable for creating a perturbation on the liquid jet, such as a thermal device, a piezoelectric device, a MEMS actuator, an electrohydrodynamic device, an optical device, an electrostrictive device, and combinations thereof. FIG. 3 shows an example of a thermal drop formation transducer 59 composed of a resistive load driven by a voltage supplied by the stimulation waveform source 56. Depending on the type of transducer used, the transducer can be located in or adjacent to the liquid chamber that supplies the liquid to the nozzles to act on the liquid in the liquid chamber, be located in or immediately around the nozzles to act on the liquid as it passes through the nozzle, or located adjacent to the liquid jet to act on the liquid jet after it has passed through the nozzle. The drop formation waveform source supplies a waveform having a fundamental frequency $f_o$ with a corresponding fundamental period of $T_o=1/f_o$ to the drop formation transducer, which produces a modulation with a wavelength $\lambda$ in the liquid jet. Fundamental frequency $f_o$ is typically close to $F_{opt}$ and always less than $F_R$. The modulation grows in amplitude to cause portions of the liquid jet break off into drops. Through the action of the drop formation device, a sequence of drops can be produced at a fundamental frequency $f_o$ with a fundamental period of $T_o=1/f_o$. In FIG. 2, liquid jet 43 breaks off into drops with a regular period at break off location 32, which is a distance BL from the nozzle 50. The distance between a pair of successive drops 35 and 36 produced at the fundamental frequency is essentially equal to the wavelength λ of the perturbation on the liquid jet. This sequence of drops breaking from the liquid jet forms a series of drop pairs 34, each drop pair having a first drop 36 and a second drop 35. Thus, the frequency of formation of drop pair 34, commonly called a drop pair frequency $f_p$, is given by $f_p=f_o/2$ and the corresponding drop pair period is $T_p=2T_o$.

The creation of the drops is associated with an energy supplied by the drop formation device operating at the fundamental frequency $f_o$ that creates drops having essentially the same volume separated by the distance λ. It is to be understood that although in the embodiment shown in FIG. 2, the first and second drops have essentially the same volume; the first and second drop may have different volumes such that pairs of first and second drop are generated on an average at the drop formation frequency. For example, the volume ratio of the first drop to the second drop can vary from approximately 4:3 to approximately 3:4. The stimulation for the liquid jet 43 in FIG. 2 is controlled independently by a drop formation transducer associated with the liquid jet or nozzle 50. In one embodiment, the drop formation transducer 59 comprises one or more resistive elements adjacent to the nozzle 50. In this embodiment, the liquid jet stimulation is accomplished by sending a periodic current pulse of arbitrary shape, supplied by the drop formation waveform source through the resistive elements surrounding each orifice of the drop generator.

The formation of a drop from the liquid stream jetted from for an inkjet nozzle can be controlled by waveforms in which at least one of the amplitude, duty cycle or timing relative to other pulses in the waveform or in a sequence of waveforms being applied to the respective drop formation transducer associated with a particular nozzle orifice. The drop forming pulses of the drop formation waveform can be controlled so that a segment of the jet that is two successive fundamental wavelengths long forms two successive drops, or forms a single larger drop. The larger drops would be produced at half the fundamental frequency and have an average spacing between adjacent large drops of 2λ.

Also shown in FIG. 2 is a charging device 83 comprising charging electrode 44 and charging voltage source 51. The charging voltage source 51 supplies a charge electrode waveform 97 which controls the voltage magnitude and duty cycle of the charge electrode voltage output with time. The charge electrode 44 associated with the liquid jet is positioned adjacent to the break off point 32 of the liquid jet 43. If a non zero voltage is applied to the charge electrode 44, an electric field is produced between the charge electrode and the electrically grounded liquid jet. The capacitive coupling between the charge electrode and the electrically grounded liquid jet induces a net charge on the end of the electrically conductive liquid jet. (The liquid jet is grounded by means of contact with the liquid chamber of the grounded drop generator.) If the end portion of the liquid jet breaks off to form a drop while there is a net charge on the end of the liquid jet, the charge of that end portion of the liquid jet is trapped on the newly formed drop.

Figure 10A:
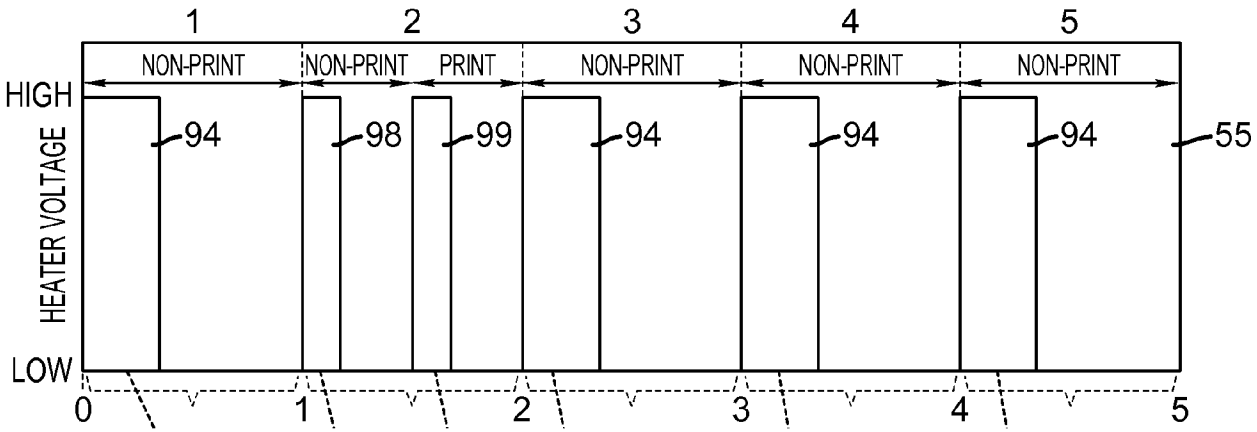
FIG. 10 shows a first example embodiment of a timing diagram illustrating drop formation pulses, the charge electrode waveform, and the break off timing of drops.
Figure 10B:
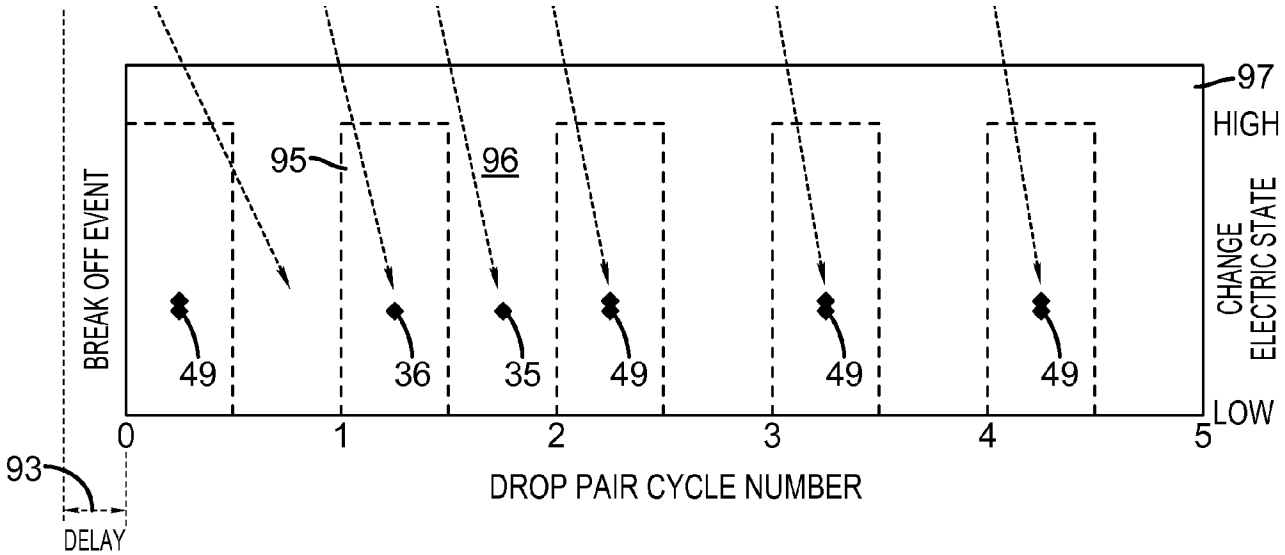

The voltage on the charging electrode 44 is controlled by a charging pulse source 51 which provides a two state waveform 97 operating at the drop pair frequency equal to $f_p=f_o/2$, that is at half the fundamental frequency, or equivalently at a drop pair period $T_p=2T_o$, that is twice the fundamental period. Thus, the charging pulse voltage source 51 provides a varying electrical potential 97 between the charging electrode 44 and the liquid jet 43. In FIG. 2, the charge electrode waveform 97 includes a first distinct voltage state and a second distinct voltage state, each voltage state being active for a time interval equal to the fundamental period. The waveform supplied to the charge electrode is independent of, or not responsive to, the image data to be printed. The charging device 83 is synchronized with the drop formation device so that a fixed phase relationship is maintained between the charge electrode waveform produced by the charging pulse voltage source 51 and the clock of the drop formation waveform source. As a result, the phase of the break off of drops from the liquid stream, produced by the drop formation waveforms, is phase locked to the charge electrode waveform. As indicated in FIG. 10, there can be a phase shift, denoted by delay 93, between the charge electrode waveform and the drop formation waveforms. The phase shift is set such that for each drop pair produced, the first drop breaks off from the jet while the charge electrode is in the first voltage state, yielding a first charge to mass ratio state on the first drop 36, and the second drop of the drop pair breaks off from the jet while the charge electrode is in the second voltage state, to produce a second charge to mass ratio state on the second drop 35 of the drop pair. The drop pair produced from a segment of the jet that is two successive fundamental wavelengths long is in response to the appropriate drop formation waveform 55 being supplied to the stimulation transducer 59.

As mentioned above, other drop formation waveforms can be used to form a large drop 49 from a segment of the jet that is two successive fundamental wavelengths long. Through the use of appropriate drop formation waveforms the segment of the jet that breaks off to form the large drop 49 can be made to break off from the jet when the charge electrode in the first voltage state (See FIG. 4B). Similarly formed large drops 49 are produced with break off times separated in time by the drop pair frequency and with the break off time synchronized with the first voltage state of the charging electrode. Thus, the time interval between the formation of successive large drops 49 is essentially the same as the time interval between the formation of successive drop pairs 34. The large drops 49 have a mass that is approximately equal to the sum of the masses of the drops 35 and 36 and being charged at break off to a charge approximately twice the charge on them as compared to the first drops 36 that break off in the corresponding voltage state of the charge electrode. Thus the charge to mass ratio on the large drops 49 breaking off in the first voltage state of the charge electrode is substantially the same as one of the first drop 36 of the drop pair. As the charge to mass ratio on the large drop 49 is substantially the same as that of drops 36, drop deflecting electric fields will deflect the charged large drop 49 by an amount that is substantially the same as they deflect the corresponding smaller drops. Waveforms used for the forming of large and small drops and the phasing of the drop break off with the charging electrode waveforms will be discussed in more detail later.

Figure 4A:
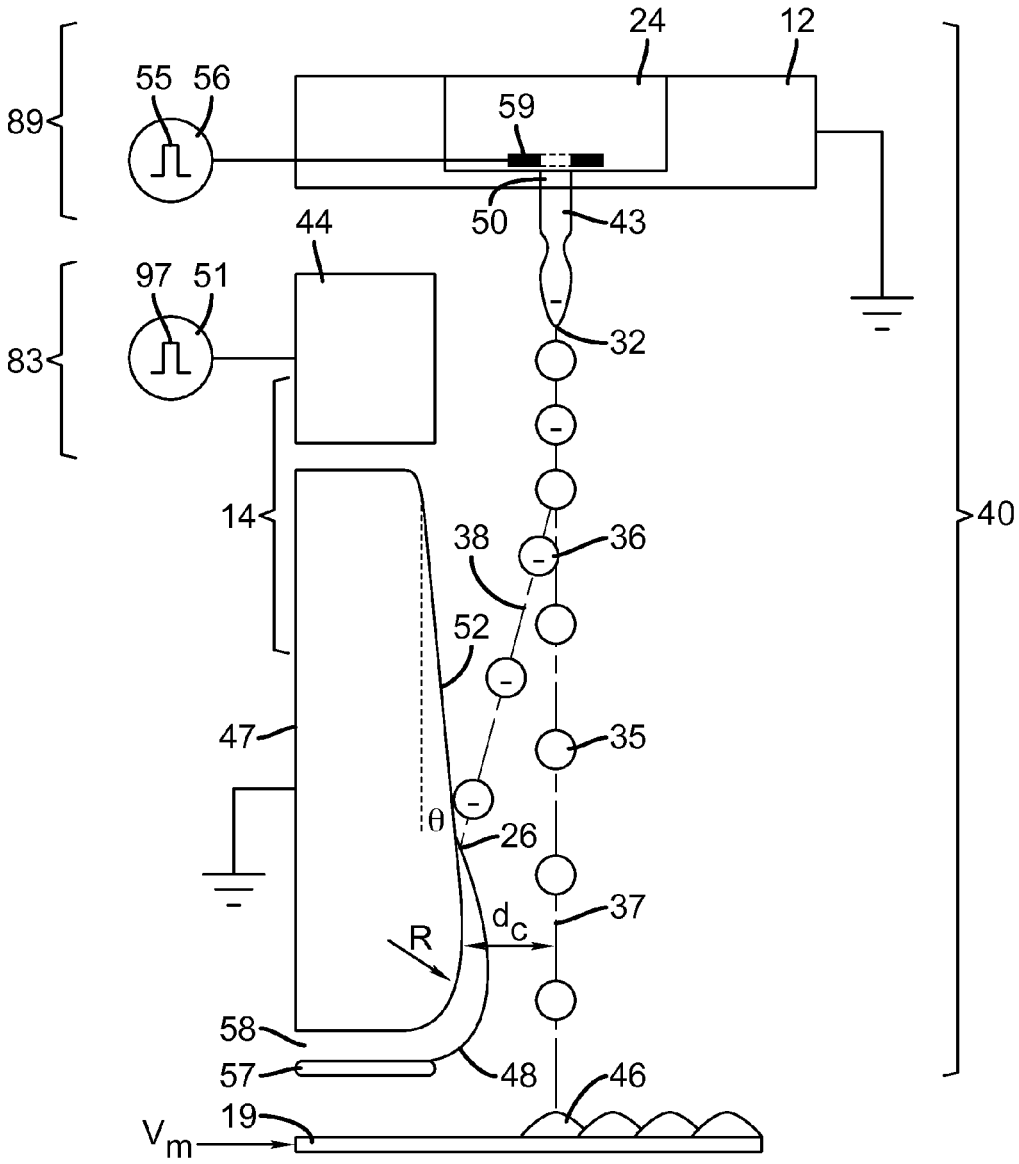
FIG. 4A shows a cross sectional viewpoint through a liquid jet of a first embodiment of the continuous liquid ejection system according to this invention and operating in an all print condition.
Figure 4B:
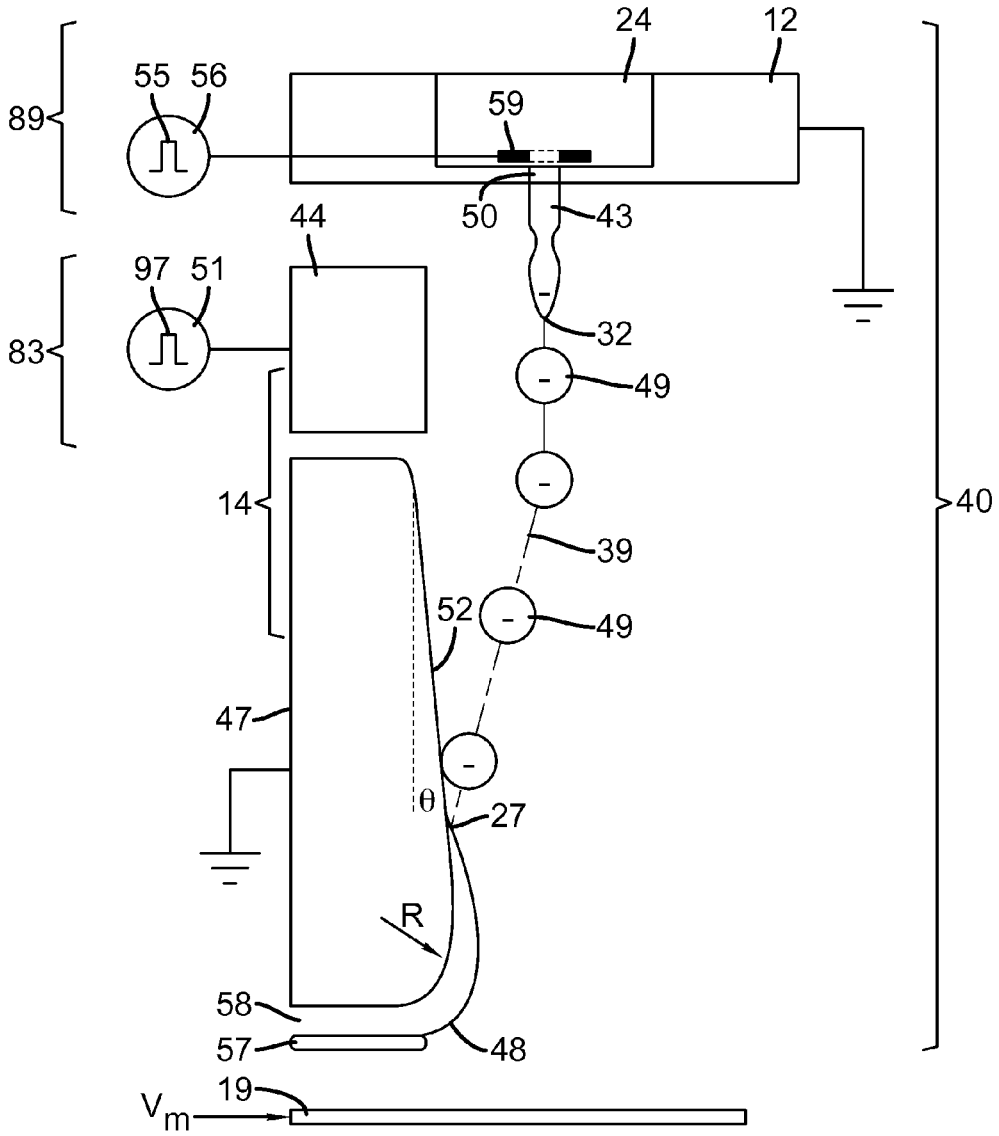
FIG. 4B shows a cross sectional viewpoint through a liquid jet of a first embodiment of the continuous liquid ejection system according to this invention and operating in a no print condition.
Figure 4C:
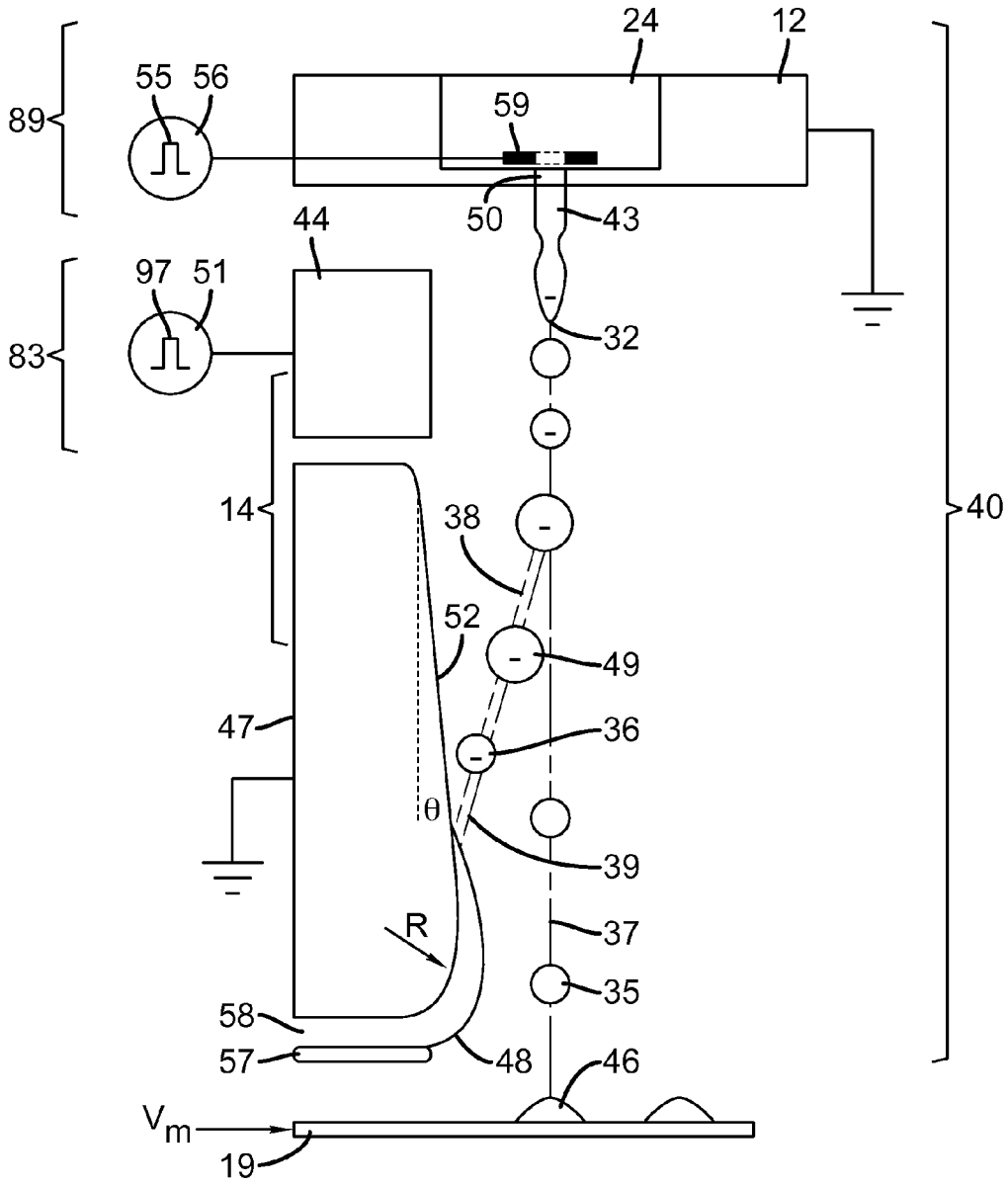
FIG. 4C shows a cross sectional viewpoint through a liquid jet of a first embodiment of the continuous liquid ejection system according to this invention and illustrates a general print condition.
Figure 5A:
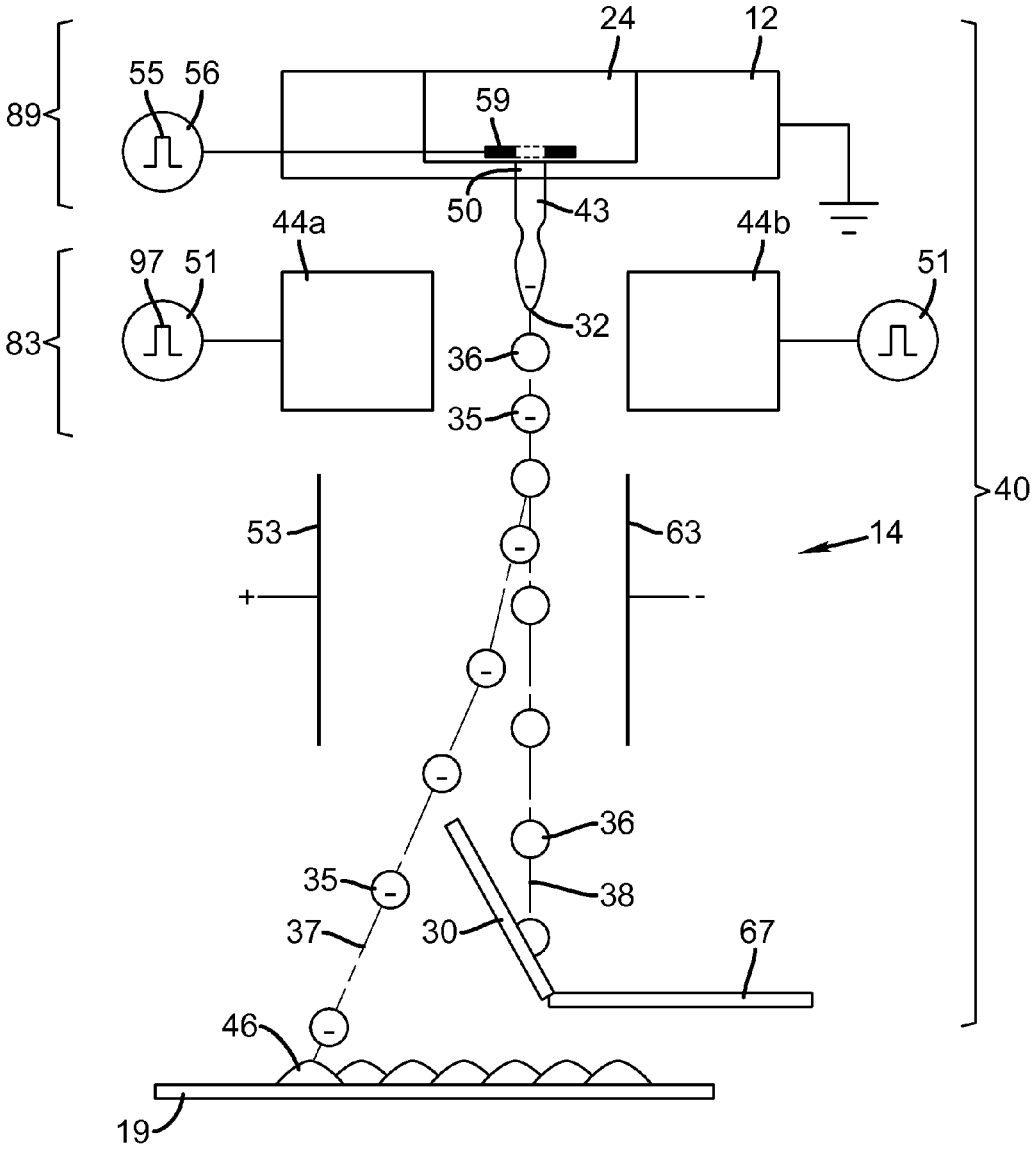
FIG. 5A shows a cross sectional viewpoint through a liquid jet of an alternate embodiment of the continuous liquid ejection system according to this invention and operating in an all print condition.
Figure 5B:
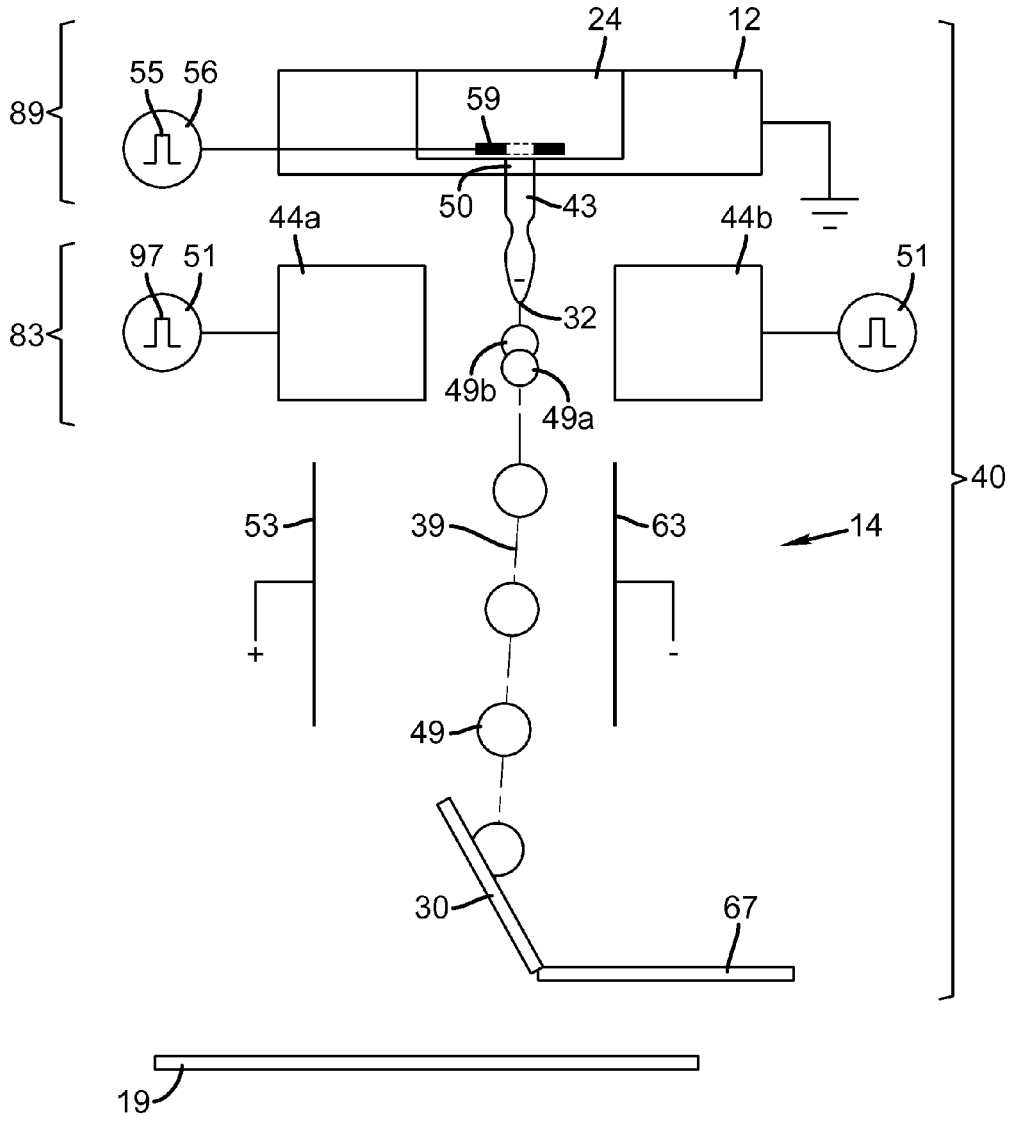
FIG. 5B shows a cross sectional viewpoint through a liquid jet of an alternate embodiment of the continuous liquid ejection system according to this invention and operating in a no print condition.
Figure 5C:
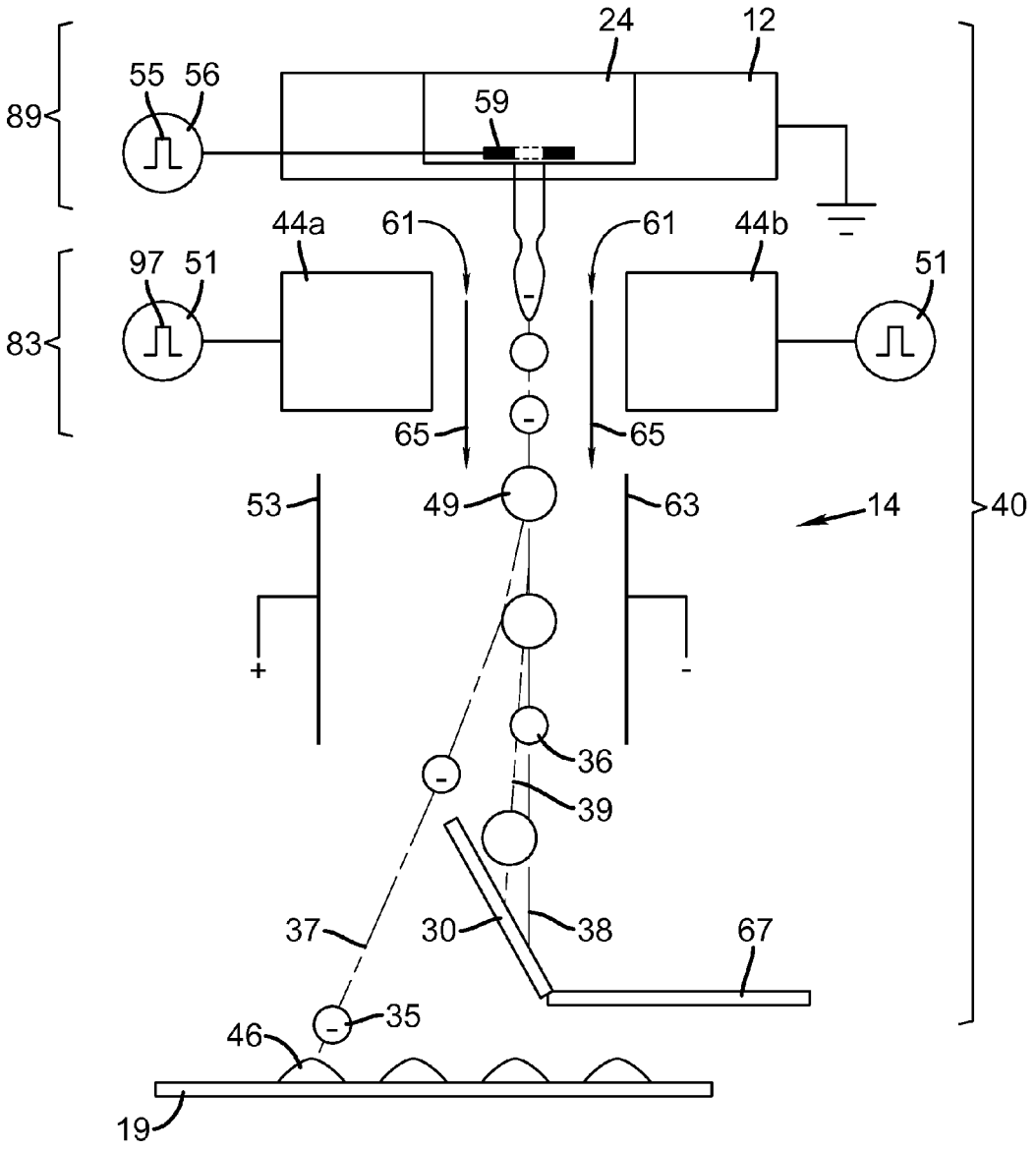
FIG. 5C shows a cross sectional viewpoint through a liquid jet of an alternate embodiment of the continuous liquid ejection system according to this invention and operating in a general print condition.
Figure 6A:
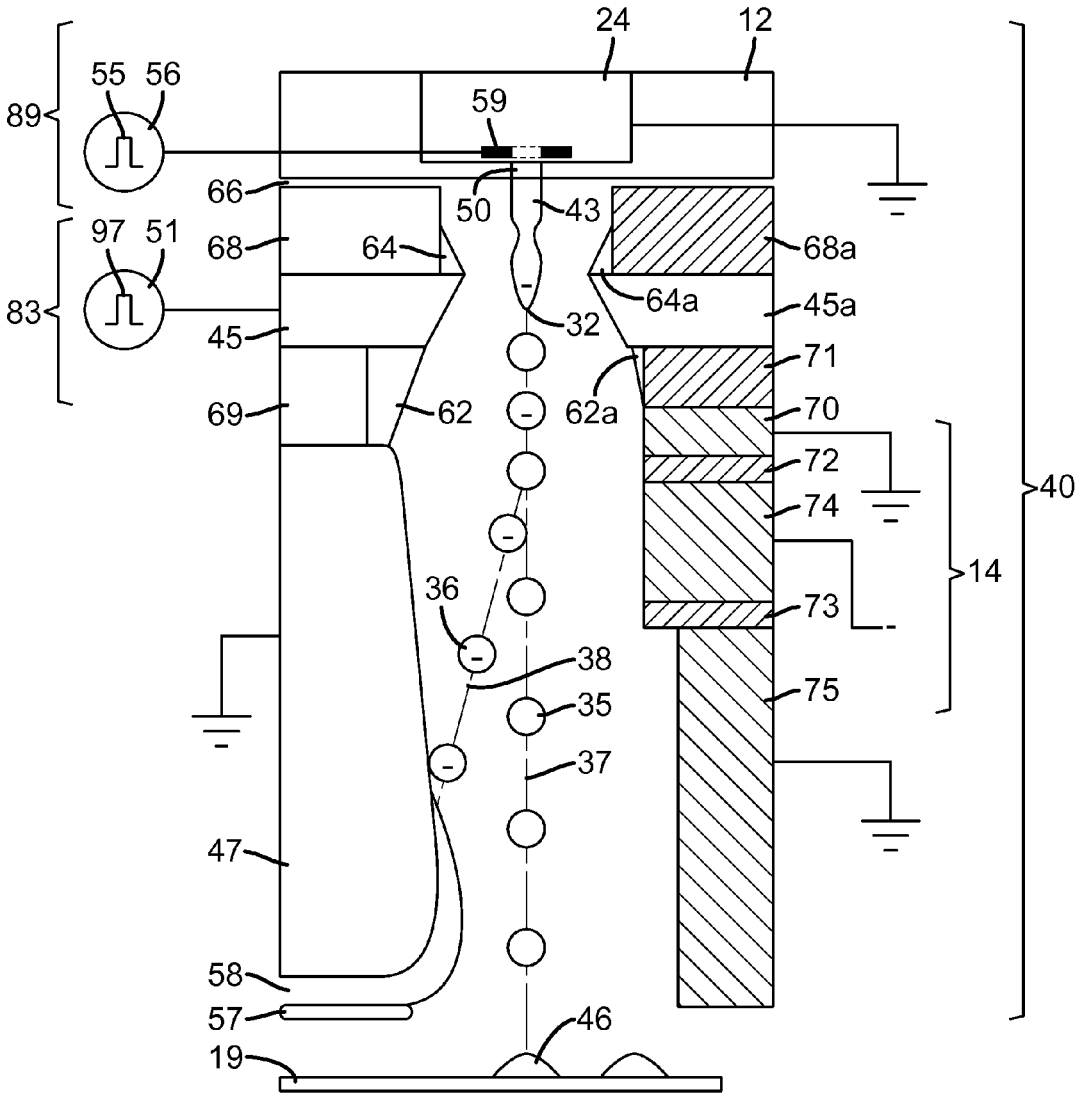
FIG. 6A shows a cross sectional viewpoint through a liquid jet of a second alternate embodiment of the continuous liquid ejection system according to this invention and operating in an all print condition.
Figure 6B:
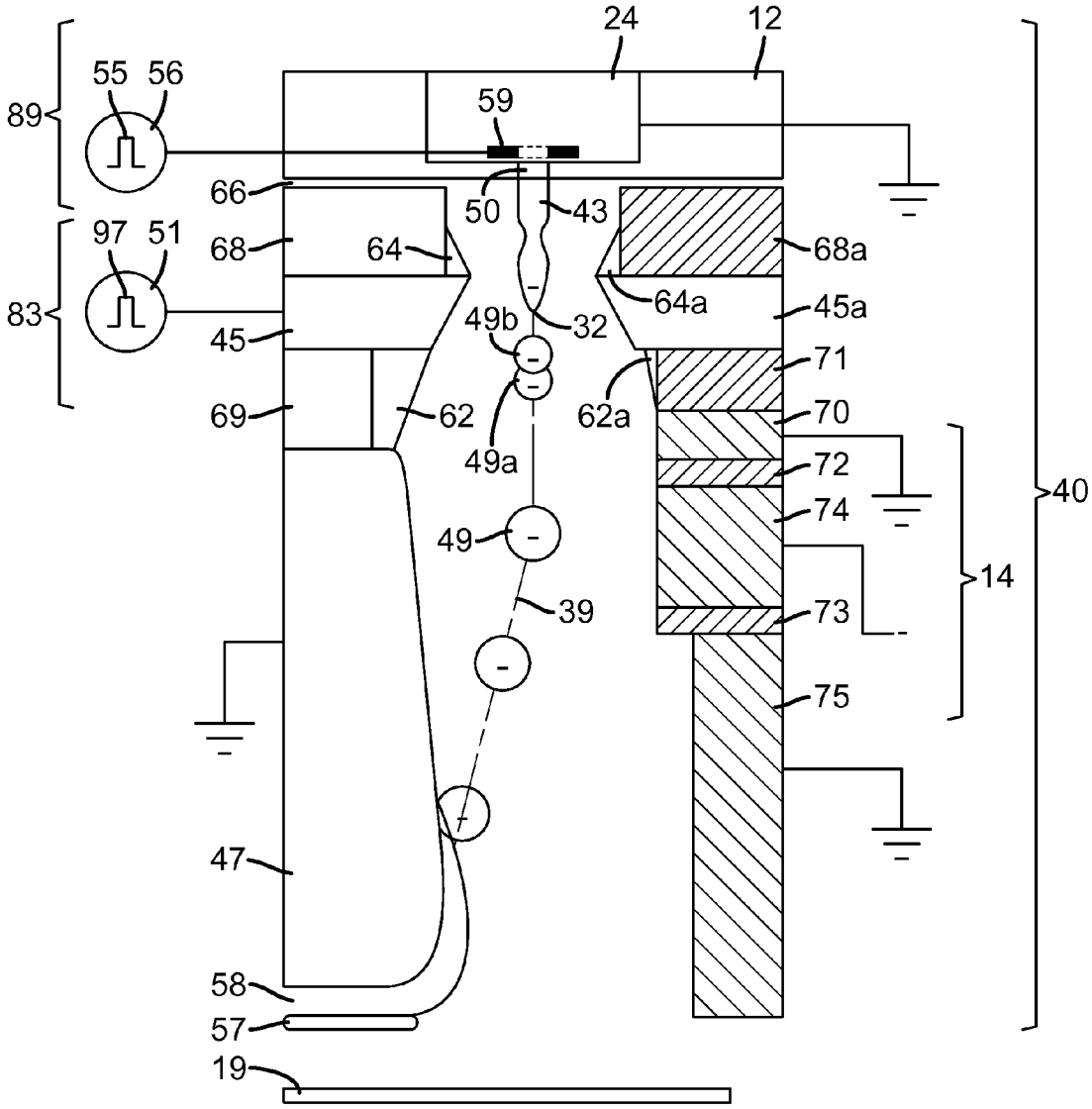
FIG. 6B shows a cross sectional viewpoint through a liquid jet of a second alternate embodiment of the continuous liquid ejection system according to this invention and operating in a no print condition.

FIG. 4A-6B show various embodiments of this invention in which either pairs of drops 35 and 36 or a single large drop 49 break off from the liquid jet 43 during each drop pair period. FIGS. 4A, 5A and 6 Å show the various embodiments in an all print mode in which continuous sequences of pairs of drops are produced at the fundamental frequency, twice the drop pair frequency, and every other drop is printed. FIGS. 4B, 5B and 6B show the various embodiments in a no print mode in which continuous sequences of larger drops 49 are produced at the drop pair frequency with a mass approximately equal to the sum of the masses of drops 35 and 36 and none of the drops are printed. FIGS. 4C and 5C show normal print modes in which both pairs of drops and larger drops are produced during the drop pair periods and one drop of each formed drop pair is printed. Thus, any pattern of dots can be printed on the recording media 19 by controlled the jet break off to form a drop pair 34 or a large drop 49 for each pixel. Usually drop pair frequency of the drop stimulation transducers for the entire array of nozzles 50 in a printhead is the same for all nozzles in the printhead 12.

In the various embodiments of the invention, the first drop 36 of a drop pair has a first charge state and travels along a first path, and the second drop 35 of the drop pair has a second charge state and travels along a second path. A catcher is positioned to intercept the first path, and does not intercept the second path so that the first drops 36 traveling along the first path are caught by the catcher and the second drops 35 travelling along the second path are not caught by the catcher. The terms first drop and second drop and the terms first voltage state and second voltage state are not intended to indicate a time ordering of the creation of the drops or of the voltage states. In FIGS. 6A and 6B, the first charge state is shown as possessing a negative charge. In an alternate embodiment, first and second waveform states are configured to cause the first drop to be positively charged rather than negatively charged. In the embodiment of FIG. 5, the first charge state corresponds to an uncharged drop state and the second charge state corresponds to the second drop being charged. The second charged state is shown as possessing a negative charge. In alternate embodiments, the second charge state can correspond to a positive charge.

Associated with the liquid jet 43 is a drop formation device 89. The drop formation device is made up of a stimulation transducer 59 and a stimulation waveform source 56 as shown in FIG. 3. The stimulation waveform source 56 provides a stimulation waveform 55 to the stimulation transducer 59 which creates a perturbation on the liquid jet 43 flowing through nozzle 50. The amplitude, duration and timing of the energy pulses of stimulation waveform 55 determine the formation of the drops, including the break off timing or phase. The time interval between break off of successive drops determines the size of the drops. Data from the stimulation controller 18 (shown in FIG. 1) is sent to the simulation waveform source 56 where it is converted to patterns of time varying voltage pulses to cause a stream of drops to form at the outlet of the nozzle 50. The specific drop stimulation waveforms 55 provided by the stimulation waveform source 56 to the stimulation transducer 59 determine the break off timing of successive drops and also the size of the drops. The drop stimulation waveforms are varied in response to the print or image data supplied by the image processor 16 to the stimulation controller 18. Thus the timing of the energy pulses applied to the stimulation transducers from the stimulation waveform depends on the print or image data. When the print data stream calls for a drop to be printed on a pixel, the waveform that is supplied to the stimulation transducer is one that will produce a pair of drops separated in time on average by the fundamental frequency, one of which will be printed. When the print data stream calls for a sequence of printed pixels, the sequence of waveforms supplied to the stimulation transducer produces a sequence of pairs of drops, and the same drop of each pair of drops will be printed. When the print data calls for a non print drop, the waveform that is supplied to the stimulation transducer is one that will produce a large drop, and when the print data calls for a sequence of non print drops, the waveform that is supplied to the stimulation transducer is one that will produce a sequence of large drops. None of these large drops will be printed. In some embodiments, the sequence of waveforms that is created based on the print data stream comprises a sequence of waveforms selected from a set of predefined waveforms. The set of predefined waveforms includes one or more waveforms for the creation of a pair of drops where the drops of the drop pairs do not merge, and one or more waveforms for the creation of a large drop. It has been found that the drop forming pulses of the drop formation waveform can be adjusted to form a single larger drop through several distinct modes; a segment of the jet that is two successive fundamental wavelengths long can break off as a unit forming a single larger drop that stays together as shown in FIG. 7A; a segment of the jet that is two successive fundamental wavelengths long can break off together as a single larger drop that then separates into two drops that subsequently merge together again as shown in FIG. 7B; or a segment of the jet that is two successive fundamental wavelengths long can break off as two separate drops which later merge into a larger drop as shown in FIG. 7C. The waveforms that cause a segment of the jet that is two successive fundamental wavelengths long to break off as two separate drops which later merge into a larger drop as shown in FIG. 7C can further be adjusted so that the break off phases of the two separate drops are close together. Thus both of the drops, which merge form large drop, can break off from the jet while the charge electrode is in the first voltage state. As a result, both drops that merge to form large drop are similarly charged to the first charge state. The merging of these drops yields a large drop 49 having a mass equal to the sum of the constituent drop masses and a charge equal to the sum of the constituent drop charges. The combined large drop formed from constituent drops having almost concurrent drop break offs has a third charge to mass ratio. The third charge to mass ratio state is similar to the first charge to mass ratio state. It is also possible that when the drop formation waveform is adjusted or selected to cause the break off phases of the two drops of the drop pair to break off while the charge electrode is in the first voltage state that they never merge before they are deflected and guttered. These drops will each have approximately the same charge to mass ratio as the first drop.

Consider a large drop 49 that is formed by a segment of the jet, which is two successive fundamental wavelengths long and which breaks off as a unit to form a single large drop while the charge electrode is in the first voltage state. The charge induced on the segment of the liquid jet breaking off is related to the surface area of the segment, and on the electric field strength at the surface of the segment. As the surface area of the segment breaking off to form the large drop is about twice the surface area of a segment that breaks off to form the first drop of a drop, and the electric fields applied by the charge electrode are similar to those applied by the charge electrode to the first drop in the drop pair, the charge induced on the large drop as it breaks off is about twice the charge of the first drop in a drop pair. Since the large drop has a mass equal to about twice the mass of the first drop in the drop pair, the charge to mass ratio of the large drop formed by a segment of the jet, which is two successive fundamental wavelengths long, breaking off together a single large drop is therefore about equal to the charge to mass ratio state of the first charge to mass ratio state. The charge to mass ratio of the large drop formed by a segment of the jet, which is two successive fundamental wavelengths long, doesn't depend on whether the large drops breaks into two drops that then coalesce or never breaks up.

FIG. 4A-6B show various embodiments of a continuous liquid ejection system 40 with particular various embodiments of charging devices 83 and deflection mechanism 14 included in the continuous liquid ejection system 40 described in detail herein. The continuous liquid ejection system 40 embodiments include components described with reference to the continuous inkjet system shown in FIG. 1. The continuous liquid ejection system 40 embodiments include liquid ejector or printhead 12 which includes a liquid chamber 24 in fluid communication with a nozzle 50 or nozzle array. (In these figures, the array of nozzles would extend into and out of the plane of the figure.) The liquid chamber 24 contains liquid under pressure sufficient to continuously eject liquid jets 43 through the nozzles 50. Each of the liquid jets has a drop formation device 89 associated with it. The drop formation device 89 includes a drop formation device transducer 59 and a drop formation waveform source 56 providing a stimulation waveform 55 operable to produce a modulation in the liquid jet to cause successive fundamental wavelength long portions of the liquid jet to break off into a series of drop pairs including a first drop 36 and a second drop 35 traveling along an initial path or a series of larger drops 49 traveling along the same initial path. The waveform provided by the waveform source 56 is adjusted, or waveforms are selected, so that either pairs of drops 35 and 36 or larger drops 49 are created during each drop pair period. The continuous liquid ejection system also includes a charging device 83 including a charge electrode 44, or 45 associated with the array of liquid jets and a source of varying electrical potential 51 between the charge electrode and the liquid jets. The source of varying electrical potential 51 applies a charge electrode waveform 97 to the charge electrode having a period that is equal to the drop pair period. The waveform includes a first distinct voltage state and a second distinct voltage state. As discussed relative to FIG. 2, the charge electrode 44 is positioned so that it is adjacent to the break off locations of the liquid jets in the nozzle array. The charging device is synchronized with the drop formation device so that the first voltage state is active when the first drop 36 of a drop pair breaks off adjacent to the electrode and the second voltage state is active when the second drop 35 of the drop pair breaks off adjacent to the electrode. As a result of the electric fields produced by the charge electrode in the first and second voltage states, a first charge to mass ratio state is produced on the first drop and a second charge to mass ratio state is produced on the second drop of each drop pair. The charging device is also synchronized with the drop formation device so that only the first voltage state is active when large drops 49 or closely spaced in time drops 49*a* and 49*b*, which break off closely in time and later combine into a single large drop 49, break off adjacent to the charge electrode 44. Thus, a third charge to mass ratio state is produced on the large drops 49. The third charge to mass ratio state is similar to the first charge to mass ratio states.

In the embodiment shown in FIG. 4A-4C, the charge electrode 44 is part of the deflection device 14. The electrically biased charge electrode 44 located to one side of the liquid jet adjacent to the break off point, not only attracts a charge to the end of the jet prior to the break off of a drop, but also attracts charged drops after they break off from the liquid jet. This deflection mechanism has been described in J. A. Katerberg, "Drop charging and deflection using a planar charge plate", 4th International Congress on Advances in Non-Impact Printing Technologies. The catcher 47 also makes up a portion of the deflection device 14. As described in U.S. Pat. No. 3,656,171, charged drops passing in front of a conductive catcher face cause the surface charges on the conductive catcher face 52 to be redistributed in such a way that the charged drops are attracted to the catcher face 52.

In order to selectively print drops onto a substrate, catchers are utilized to intercept drops traveling down the first paths and the third path. FIG. 4A-4C and FIG. 6A-6B show embodiments in which the catcher intercepts drops traveling along the first and third paths while drops traveling down the second path are allowed to contact a substrate and be printed. In these embodiments, the first and third charge states are more highly charged than the second charge state. FIG. 5A-5C show an embodiment in which the catcher intercepts drops traveling along the first and third paths while drops traveling down the first path are allowed to contact a substrate and be printed. In this embodiment, the second charge state is more highly charged than the first and third charge states.

FIG. 4A-4C show cross sectional views of the main components of a continuous liquid ejection system and demonstrate different print modes of a first embodiment of this invention. The continuous liquid ejection system includes a printhead 12 comprising a liquid chamber 24 in fluid communication with an array of one or more nozzles 50 for emitting liquid streams 43. Associated with each liquid jet is a stimulation transducer 59. In the embodiments shown, the stimulation transducer 59 is formed in the wall around the nozzle 50. Separate stimulation transducers 59 can be integrated with each of the nozzles in a plurality of nozzles. The stimulation transducer 59 is actuated by a drop formation waveform source 56 which provides the periodic stimulation of the liquid jet 43.

A grounded catcher 47 is positioned below the charge electrode 44. The purpose of catcher 47 is to intercept or gutter charged drops so that they will not contact and be printed on print medium or substrate 19. For proper operation of the printhead 12 shown in FIG. 4A and subsequent figures the catcher 47 and/or the catcher bottom plate 57 are grounded to allow the charge on the intercepted drops to be dissipated as the ink flows down the catcher face 52 and enters the ink return channel 58. The catcher face 52 of the catcher 47 makes an angle θ with respect to the liquid jet axis 87 which is shown in FIG. 2. As shown in FIG. 4A charged drops 36 are attracted to catcher face 52 of grounded catcher 47. Drops 36 intercept the catcher face 52 at charged drop catcher contact point 26 to form an ink film 48 traveling down the face of the catcher 47. The bottom of the catcher has a curved surface of radius R, includes a bottom catcher plate 57 and an ink recovery channel 58 above the bottom catcher plate 57 for capturing and recirculation of the ink in the ink film 48. If a positive voltage potential difference exists from the electrode 44 to the liquid jet 43 at the time of break off of a drop breaking off adjacent to the electrode, a negative charge will be induced on the forming drop that will be retained after break off of the drop from the liquid jet. If no voltage potential difference exists from the electrode 44 to the liquid jet 43 at the time of break off of a drop it would be expected that no charge will be induced on the forming drop that will be retained after break off of the drop from the liquid jet. However, as the second drop 35 breaking off from the liquid jet is capacitively coupled to the charged first drop 36, a small charge can be induced on the second drop even when the charge electrode is at 0 V in the second charge state.

For simplicity in understanding the invention, FIG. 4A-4C are drawn for the case where the second charge state is near zero charge so that there is little or no deflection of the second drop of a drop pair 35 as shown by the direction of the second path 37. For simplicity in understanding, the second path 37 is drawn to correspond with the liquid jet axis 87 shown in FIG. 2. In actuality there may be a small charge on the drops following the second path in which case path 37 would deviate from the liquid jet axis 87. The first drop of a drop pair 36 is in a high charge state so that the first drops 36 are deflected as they travel along the first path 38. This invention thus allows printing of one print drop per drop pair cycle, at the drop pair frequency $f_p=f_o/2$ or at drop pair period $T_p=2T_o$. We define this as a small drop print mode which enables printing of one of the drops of a drop pair, the drop being formed at the fundamental frequency $f_o$ which can be tuned to the optimum frequency for jet break off, as opposed to a large drop printing mode in which the large combined drops are used for printing.

As described above, a small charge can be induced on the second drop even when the charge electrode is at 0 V in the second charge state. The second drop can therefore undergo a small deflection. In certain embodiments, the charge induced on the second drop by the charge of the first drop is neutralized by altering the second voltage state of the charge electrode waveform. Rather than use 0 volts at the second voltage state, a small offset from 0 volts is used. The offset voltage is selected so that the charge induced on the drop breaking off adjacent to the charge electrode during the second voltage state has the same magnitude and of opposite polarity to the charge induced on the drop breaking off by the preceding drops. The result is a drop with essentially no charge that undergoes essentially no deflection due to electrostatic forces. The amount of DC offset depends on the specific configuration of the system including, for example, whether one charging electrode or two charging electrodes are used in the system, or the geometry of the system including, for example, the relative positioning of the jet and the charging electrode(s). Typically, the range of the second voltage state to the first voltage state is between 33% and 10%. For example, in some applications when the first voltage state includes 200 volts, the second voltage state includes a DC offset of 50 volts (25% of the first voltage state).

Successive drops 36 and 35 are considered to be a drop pair with a first drop of a drop pair 36 being charged by a charge electrode to a first charge to mass ratio state and a second drop of the drop pair 35 being charged to a second charge to mass ratio state by the charge electrode. FIG. 4A shows an all print condition in which a long sequence of drop pairs are formed. Due to the different charge to mass ratios on these two drops, they undergo different amounts of deflection due to the deflection device 14 which includes the grounded gutter 47 and the charging device 83 which comprises electrode 44, charging voltage source 51 and the charge electrode waveform 97. The charge electrode waveform is independent of the print data and has a repeat frequency of one half the fundamental frequency of drop formation of drops 35 and 36. The first drop 36 is deflected to follow the first path 38 while the second drop 35 follows the second path 37 to strike the recording media 19 thus depositing printed ink drops 46 onto the recording media 19 while the media is moving at a velocity $v_m$.

FIG. 4A shows a cross sectional viewpoint through a liquid jet 43 of a first embodiment of the continuous inkjet system according to this invention and illustrates a sequence of drop pairs in an all print condition with the second drop 35 of each pair of drops being charged by charge electrode 44 to a second charge to mass ratio state and not being attracted to a catcher 47 and are printed on recording medium 19 as a sequence of printed drops 46 and the first drop 36 of the drop pair being charged to a first charge to mass ratio state by the charge electrode 44 and are attracted to the catcher 47 and are not printed. For the drops being produced as shown in FIG. 4A, successive drops are created at the fundamental period by stimulation of drop formation waveform source 56 with stimulation waveform 55 at the fundamental period $T_o$. As a result, the first and second drops in the drop pairs do not merge and are separated in distance by λ. An appropriate waveform being applied to electrode 44 would be a square wave of approximately 50% duty cycle with a period equal to the drop pair period of $T_p \rightarrow 2T_o$ and a positive voltage in the high state and ground at the low state.

FIG. 4B shows a no print condition in which a long sequence of large drops 49 are formed at half the fundamental frequency. The large drops 49, after breaking off adjacent to the electrode while the high voltage is on, the first voltage state, have a net charge that is approximately equal to twice the charge on the first drops 36. The net charge on the large drops corresponds to a third charge to mass ratio state. The deflection device acts on the large drops 49 having a third charge to mass ratio state, causing the large drops to travel along a third path 39. Since the large drops 49 have a similar charge to mass ratio as the charged first drops 36, they undergo a similar magnitude of deflection as the first drops 36. As a result, the large drops 49 travels along a third path 39 that is similar to the first path 37 and is intercepted by catcher face 52 at charged drop catcher contact point 27 to form an ink film 48 traveling down the face of the catcher 47. Catcher contact point 26 for first drops 36 is similar in height to catcher contact point 27 for large drops 49. Thus, as is shown in FIG. 4B in a sequence of drop pairs in the no print condition, all drop pairs are combined and guttered and no print drops 46 occur on the recording medium 19.

FIG. 4C shows a normal print sequence in which drop pairs 35 and 36 are generated along with some larger drops 49. Drops 35 are printed as printed ink drops 46 onto moving recording media 19 and charged drops 36 and charged larger drops 49 are guttered and not printed. The pattern of printed ink drops 46 would correspond to image data from the image source 13 as described with reference to the discussion of FIG. 1.

FIGS. 5A-5C show an alternate embodiment of the continuous inkjet system according to this invention. Shown are cross sectional viewpoints through a liquid jet of in which large drops 49 and non-deflected first drops 36 are guttered with deflected second drops 35 being printed. FIG. 5A shows a sequence of drop pairs in an all print condition, FIG. 5B shows a sequence of drop pairs in a no print condition and FIG. 5C shows a normal print condition in which some of the drops are printed. In FIG. 5B, large drops 49 are shown near break off as two separate drops 49*a* and 49*b* which may break off together and then separate and remerge into a single large drop 49. Drops 49*a* and 49*b* may also break off separately as two drops at nearly the same time and then merge into a single large drop. In this embodiment, the first voltage state corresponds to the low or zero voltage state, so that the first charge state on the first drop of the drop pair is uncharged relative to the second charge state on the second drops of the drop pairs.

Figure 7:
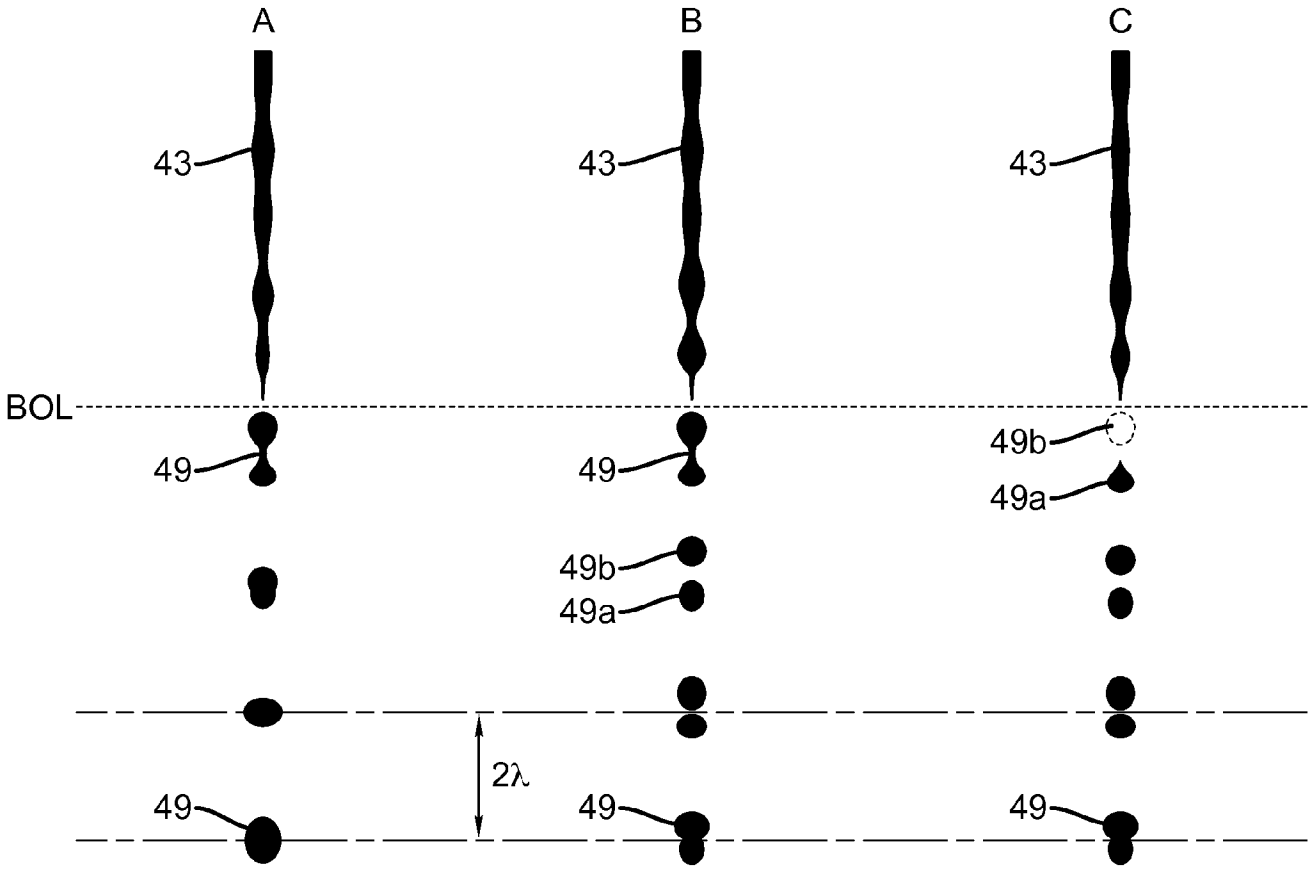
FIG. 7 shows images of a liquid jet being ejected from a drop generator at its subsequent break off into drops being generated at half the fundamental frequency. A shows pairs of drops breaking off as a single drop and staying combined, B shows pairs of drops breaking off as a single drop, separating and then recombining, and C shows drops breaking off individually with similar break off timing and then combining into a single drop.

FIG. 7 shows images of drops breaking off from a jet stream 43 at half the fundamental frequency to create large drops 49 utilizing different stimulation waveforms applied to the drop formation transducer. Changing the stimulation waveform applied to the drop formation transducer causes the drop formation dynamics to change as shown in A, B and C of FIG. 7. A shows pairs of drops breaking off as a single drop 49 and staying combined, B shows pairs of drops breaking off as a single drop 49, separating into drops 49*a* and 49*b* and then recombining, and C shows drops 49*a* and 49*b* breaking off individually with almost simultaneous break off timing and then combining into a single drop 49. The average distance between large drops once they are fully formed is 2λ. All drops break off from the jet at the break off plane shown as BOL in FIG. 7.

In the embodiment shown in FIG. 5A-5C, the charge electrode 44 includes a first portion 44*a* and a second portion 44*b* positioned on opposite sides of the liquid jet, with the liquid jets breaking off between the two portions. Typically, the first portion 44*a* and second portion 44*b* of charge electrode 44 are either separate and distinct electrodes or separate portions of the same device. As in the discussion of FIG. 4A-4C, the charging voltage source 51 delivers a repetitive charge electrode waveform 97 at the drop pair frequency of drop formation so that the first drop 36 of a sequential pair of drops is charged by charge electrode 44 to a first charge state and the second drop 35 of the drop pair is charged to a second charge state by the charge electrode 44. The left and right portions of the charge electrode are biased to the same potential by the charging pulse source 51. The addition of the second charge electrode portion 44*b* on the opposite side of the liquid jet from the first portion 44*a*, biased to the same potential, produces a region between the charging electrode portions 44*a* and 44*b* with an electric field that is almost symmetric left to right about the center of the jet. As a result, the charging of drops breaking off from the liquid jet between the electrodes is very insensitive to small changes in the lateral position of the jet. The near symmetry of the electric field about the liquid jet allows drops to be charged without applying significant lateral deflection forces on the drops near break-off. In this embodiment, the deflection mechanism 14 includes a pair of deflection electrodes 53 and 63 located below the charging electrode 44*a* and 44*b* and below the merge point of drops 49*a* and 49*b* into a single large drop 49. The electrical potential between these two electrodes produces an electric field between the electrodes that deflects negatively charged drops to the left. The strength of the drop deflecting electric field depends on the spacing between these two electrodes and the voltage between them. In this embodiment, the deflection electrode 53 is positively biased, and the deflection electrode 63 is negatively biased. By biasing these two electrodes in opposite polarities relative to the grounded liquid jet, it is possible to minimize their contribution to the charge of drops breaking off from the liquid jet.

In the embodiment shown in FIG. 5A-5C, a knife edge catcher 67 has been used to intercept the non-print drop trajectories. Catcher 67, which includes a gutter ledge 30, is located below the pair of deflection electrodes 53 and 63. The catcher 67 and gutter ledge 30 are oriented such that the catcher intercepts drops traveling along the second path 37 for single uncharged drops as shown in FIG. 5A and also intercepts large drops 49 traveling along the third path 39 as shown in FIG. 5B, but does not intercept single charged drops 36 traveling along the first path 38. Preferably, the catcher is positioned so that the drops striking the catcher strike the sloped surface of the gutter ledge 30 to minimize splash on impact. The charged drops 36 with a first charge to mass ratio traveling along the first path 38 are printed on the recording medium 19.

For the discussion below we assume that the charging pulse source 51 delivers approximately a 50% duty cycle square wave waveform at half the fundamental frequency of drop formation. When electrode 44 has a positive potential on it a negative charge will develop on drop 36 as it breaks off from the grounded jet 43. When there is little or no voltage on electrode 44 during formation of drop 35 there will be little or no charge induced on drop 35 as it breaks off from the grounded jet 43. A positive potential is placed on deflection electrode 53 which will attract negatively charged drops towards the plane of the deflection electrode 53. Placing a negative voltage on deflection electrode 63 will repel the negatively charged drops 36 from deflection electrode 63 which will tend to aid in the deflection of drops 36 toward deflection electrode 53. The fields produced by the applied voltages on the deflection electrodes will provide sufficient forces to the drops 36 so that they can deflect enough to miss the gutter ledge 30 and be printed on recording medium 19. In order for the configuration shown in FIG. 5A-5C to function properly, the phase of the two state waveform 97 must be approximately 180 degrees out of phase with the 2 state waveform 97 utilized in the configuration shown in FIG. 4A-4C. For the FIG. 5A-5C configurations drops 35 and large drops 49 are uncharged with print drops 36 being charged while in the configuration shown in FIG. 4A-4C drops 36 and large drops 49 are charged while print drops 35 are uncharged.

FIG. 5C shows a normal print sequence in which drop pairs 35 and 36 are generated along with some larger drops 49. Charged drops 36 are printed as printed ink drops 46 onto moving recording media 19 and uncharged drops 36 and uncharged large drops 49 are guttered and not printed. The pattern of printed ink drops 46 would correspond to image data from the image source 13 as described with reference to the discussion of FIG. 1. In the embodiment shown in FIG. 5C, an air plenum 61 is formed between the charge electrode and the nozzle plate of the geometry. Air, supplied to the air plenum by an air source (not shown), surrounds the liquid jet and stream of drops as they pass between the first and second portions of the charge electrode, 44*a* and 44*b* respectively, as indicated by arrows 65. This air flow moving roughly parallel to the initial drop trajectories helps to reduce air drag effects on the drops that can produce drop placement errors.

FIG. 6A-6B shows cross sectional viewpoints through a liquid jet of a second alternate embodiment of a continuous inkjet system according to this invention having an integrated electrode and gutter design. FIG. 6A illustrates a sequence of drop pairs in an all print condition and FIG. 6B illustrates a sequence of drop pairs in a no print condition. All of the components shown on the right side of the jet 43 are optional. Insulator 68 and optional insulator 68*a* are adhered to the top surfaces of charge electrode 45 and optional second charge electrode portion 45*a* respectively and act as spacers to ensure that the charge electrode 45 and optional charge electrode 45*a* are located adjacent to the break off location 32 of liquid jet 43. A gap 66 may be present between the top of insulator 68 and the outlet plane of the nozzle 50. The edges of charge electrode 45 and 45*a* facing the jet 43 are angled in FIG. 6A and FIG. 6B to maximize the intensity of the electric field at the break off region which will induce more charge on the charged drops 36. Insulating spacer 69 is also adhered to the bottom surface of charge electrode 45. Optional insulating spacer 71 is adhered to the bottom surface of optional charge electrode 45*a*. The bottom region of insulator 68 has an insulating adhesive 64 in the vicinity of the top surface of charge electrode 45 facing the liquid jet 43. Similarly the bottom region of optional insulator 68*a* has an insulating adhesive 64*a* in the vicinity of the top surface of charge electrode 45*a* facing the liquid jet 43. The insulating spacer 69 also has an insulating adhesive 62 adhering to the side facing the ink jet drops and the bottom surface of electrode 45. Optional insulating spacer 71 also has an insulating adhesive 62*a* adhering to the side facing the ink jet drops and the bottom surface of electrode 45. The purpose of the insulating adhesives 64, 64*a*, 62 and 62*a* is to prevent liquid from forming a continuous film on the surface of the insulators and to keep liquid away from the electrode 45 to eliminate the possibility of electrical shorting. The grounded gutter 47 is adhered to the bottom surface of insulating spacer 69 and insulating adhesive 64 as shown in FIGS. 6A and 6B. Adhering to the bottom surface of optional insulating spacer 71 is a grounded conductor 70. Another optional insulator 72 adheres to the bottom surface of grounded conductor 70. An optional deflection electrode 74 facing the top region of gutter 47 adheres to the bottom surface of insulator 72. Optional insulator 73 adheres to the bottom surface of deflection electrode 74. Grounded conductor 75 is located adjacent to the bottom region of gutter 47 and is adhered to the bottom surface of insulator 73. Grounded conductor 70 acts as a shield between electrode 45*a* and deflection electrode 74 to isolate the drop charging region near drop break off from the drop deflection fields in front of the catcher. This helps to ensure that the drops as they are breaking off from the jet are not charged as a result of the electric fields produced by the deflection electrode. The purpose of the grounded conductor 75 is to shield the drop impact region of the catcher from electric fields produced by the deflection electrode. The presence of such fields in the drop impact region can contribute to the generation of misting and spray from the gutter 47 surface. The deflection electrode 74 functions in the same manner as the deflection electrode 63 shown in FIG. 5A-FIG. 5C.

Figure 8:
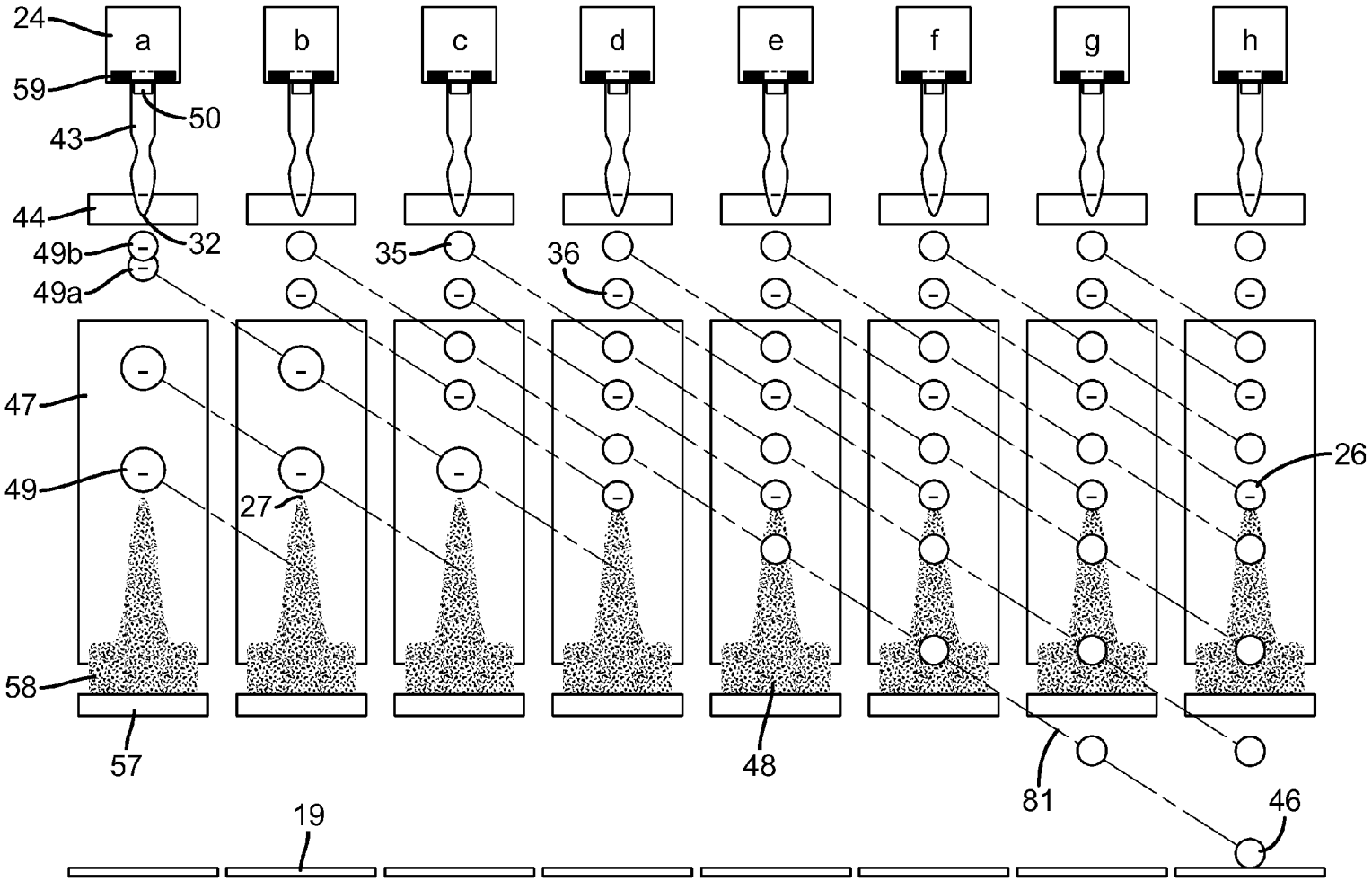
FIG. 8 shows a front view of drops being produced from a jet in a time lapse sequence from a to h producing successive drop pairs according to the continuous liquid ejection system of the invention.

FIG. 8 shows a front view of a stream of drops being produced from a single jet in a time lapse sequence from a to h producing successive drop pairs according to the continuous inkjet system of the invention. FIG. 8*a* shows a sequence of non print large drops 49 (drops 49*a* and 49*b* at break off) being produced which break off from liquid jet 43 at break off location 32 adjacent to charge electrode 44 and intercepting the gutter at charged large drop gutter contact point 27 thus forming an ink film 48 that flows down the surface of catcher 47. The ink film flowing down the catcher face, flows around the radius (shown as R in FIG. 4A) at the bottom of the catcher face and flows into the ink recovery channel 58 between the catcher 47 and the catcher bottom plate 57, from which it is collected by the ink recycling unit 15 of the printer. The ink recovery channel 58 is kept under vacuum to facilitate recycling of the ink film 48*a* into the ink recycling unit of the printer. Charged large drops 49 are all guttered and are not printed in this mode of operation. FIG. 8*b* shows the next drop pair being generated to produce a first print drop after a sequence of non print drops. The first (lower) drop 36 of the drop pair is charged and the second (higher) drop 35 is uncharged. The uncharged drop is printed and the charged drop is guttered and caught by the catcher 47. FIG. 8*c*-8*h* show successive print drop pairs being generated. Diagonal dotted-dashed lines 81 called drop time lapse sequence indicators indicate the location of the same drop in successive diagrams. The last non-print drop pair being formed in FIG. 8*a* is shown to intercept the catcher at charged combined drop gutter contact point 27 in FIG. 8*c*. The first charged drop 36 of the first print drop pair being formed in FIG. 8*b* is shown to intercept the catcher at charged drop gutter contact point 26 in FIG. 8*d*. The contact point 26 on the catcher for single drops is similar in location to the contact point for large drops 27 since the charge to mass ratio is roughly the same for non print drops 36 and large non print drops 49. The uncharged print drop 35 of the first print drop pair being formed in FIG. 8*b* is shown to reach the recording medium 19 and be printed as a print drop 46 in FIG. 8*h*.

Figure 9:
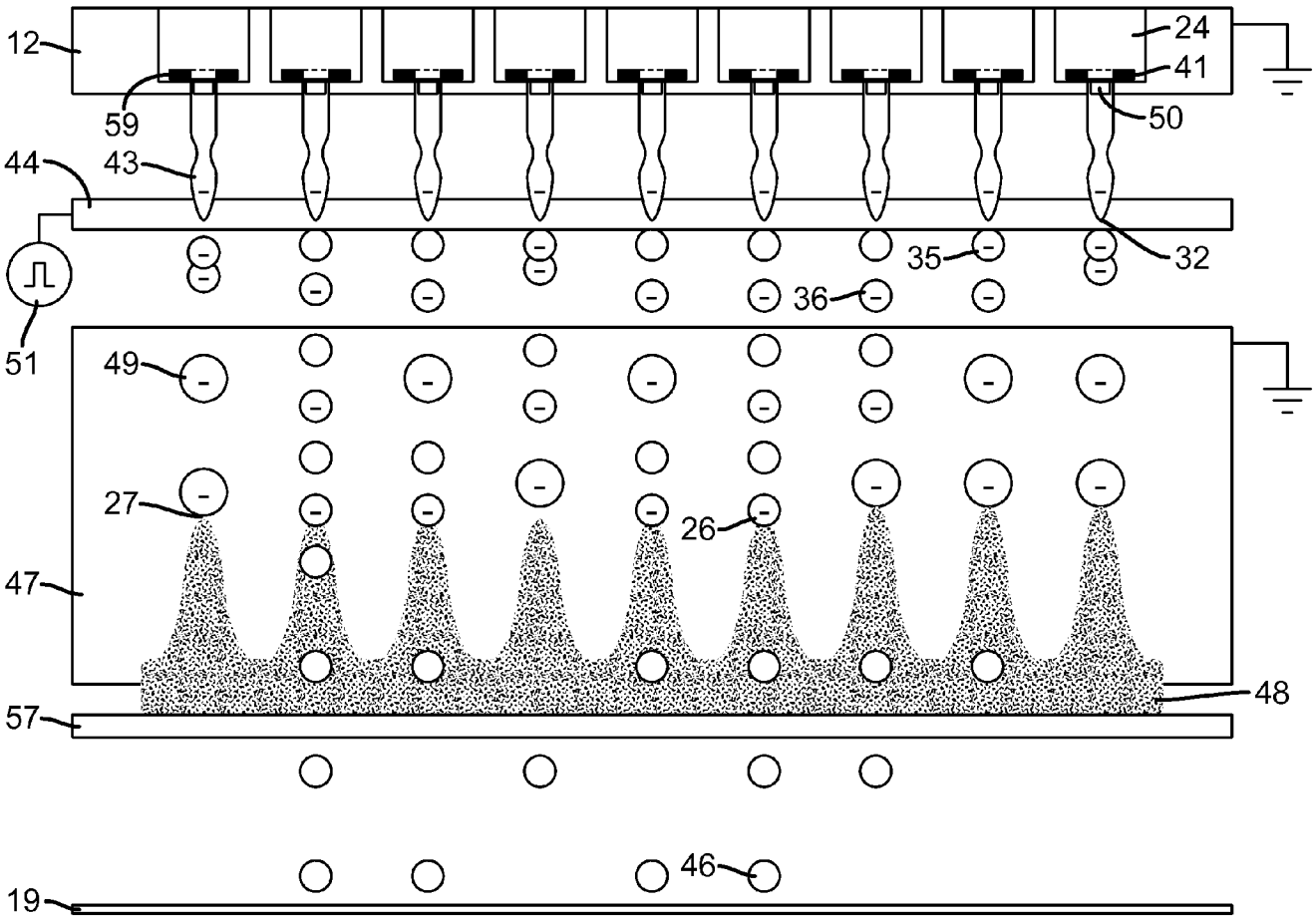
FIG. 9 illustrates a front view point of several adjacent liquid jets of the continuous liquid ejection system of the invention.

FIG. 9 illustrates a front view point of an array of 9 adjacent liquid jets 43 of a printhead 12 of the continuous inkjet system of the invention during printing. The various nozzles show different print and non-print sequences which would occur during normal printing operations. Charge electrode 44 and catcher 47 are common to the jets emitted from all nozzles in a linear array of nozzles of the printhead. The charge electrode 44 is associated with each of the liquid jets from the array of nozzles, being positioned adjacent to the break off locations 32 of the various jets as required for proper operation of this invention. A continuous ink film 48 is formed across the entire catcher surface when charged drops 36 and charged large drops 49 intercept the catcher and uncharged drops 35 are printed. As the path 38 of charged drops 36 and path 39 of the charged large drops 49 are substantially the same, all guttered drops intercept the catcher surface at approximately the same height. This is desirable to create a steady uniform ink film on the catcher surface and to enable high drop placement accuracy. The ink film 48 on the gutter is collected in the channel between catcher 47 and the common catcher bottom plate 57 and sent to the ink recycling unit of the printer.

FIG. 10 shows timing diagrams illustrating drop formation pulses (drop stimulation waveform), the charge electrode waveform, and the break off timing of drops according to an embodiment of this invention. The top section A of FIG. 10 shows the drop stimulation waveforms (heater voltage waveforms 55) as a function of time for a single nozzle of a linear array of nozzles. The lower section B of FIG. 10 shows the common charge electrode voltage waveform as a function of time along with the break off timing of the drops produced by the respective drop stimulation waveforms shown in section A of the respective figure. The time axis in both sections of FIG. 10 are shown in drop pair periods, numbered from 1-5, which is equal to twice the fundamental period of drop formation for drops 36 and 35. The plots shown in FIG. 10 show a pair of drops being formed during drop pair cycle number 2 in which one of them is printed and one of them is guttered (not printed) while in drop pair cycle numbers 1, 3, 4, 5 only non-printed large drops are formed and guttered. The drop formation waveform in the second drop pair cycle includes a portion of the waveform that leads to the formation of the first drop, the portion including the print drop forming pulse 98, and another portion of the waveform, the portion including the non-print drop forming pulse 99, that leads to the formation of the second drop. Section B of FIG. 10 illustrates the charging voltage V as a function of time, commonly called a charge electrode waveform 97 supplied by the charging voltage source 51 to the charge electrode (44 or 45) along with the times at which the drop break off events occur. The charge electrode waveform 97 is shown as the dashed curve and it is shown as a 50% duty cycle square wave going from a high positive voltage state to a low voltage state with a period equal to the drop pair period, which is twice the fundamental period of drop formation so that one drop pair of two drops or one large drop 49 can be created during one drop charging waveform cycle. The drop charging waveform for each drop pair time interval includes a first voltage state 96, and a second voltage state 95. The first voltage state corresponds to a high positive voltage and the second voltage state corresponds to a low voltage near 0 volts. The moment in time at which each drop breaks off from the liquid jet is denoted in section B as a diamond. Arrows have been drawn from the drop formation pulses occurring during each drop pair time interval shown in section A of FIG. 10 to the corresponding break off times for each of the respective drops in section B. The delay time 93 shows the time delay between the start of the first drop formation heater voltage pulse in each drop pair time interval and the start of each charging waveform cycle. The timing of the starting phase of the charge electrode waveform 97 is adjusted to properly distinguish the charge level difference between the drops that are to print and those that are not to print. The timing shown in FIG. 10 is appropriate for the embodiments shown in FIGS. 4 and 6 where first drops 36 of drop pairs and large drops 49 are the charged drops and second drops 35 of drop pairs are the uncharged drops. A change in the delay time 93 by one half of the drop pair period would yield charged second drops 35 and uncharged first drops 36 and large drops 49; appropriate for the embodiment shown in FIG. 5. Thus, the delay time 93 is used to synchronize the drop formation device with the electrode charging voltage source so as to maintain a fixed phase relationship between the charge electrode waveform and the drop formation waveform sources clock.

FIG. 10 illustrates a configuration in which large drops break off together as a single large drop 49. Each non-print drop pair cycle 1, 3, 4, 5 includes a large drop forming pulse 94 for creating a large drop 49. The drop pair cycle 2, has print drop forming pulse 98 and a non-print drop forming pulse 99. The pulse width of the large drop forming pulses 94 can be adjusted to change the break off timing of the large drops 49 so that they break off during the high voltage charge state 96. During drop pair cycle 2, drop formation pulse 98 causes the first drop 36 to break off during the high voltage state 95. The drop formation pulse 99 causes the second drop 35 to break off during the subsequent low voltage state 96. Drops 36 and 49, which break off during the high voltage state 95 are charged by the electric fields produced by the charge electrode, while drop 35 is not charged by the charge electrode.

FIG. 10 illustrates an embodiment in which low or non-charged drops are printed. For embodiments in which the charged drops are to be printed and uncharged drops are to be caught, the starting phase of the charge electrode waveform 97 is phase shifted by adjusting the delay time 93 between the start of the first drop formation heater voltage pulse in each drop pair time interval and the start of the charging waveform cycle. As an example adding one fundamental period of a drop to the delay time 93 will cause large drops 49 and drops 36 to be in the low charge state at break off while drops 35 will be in the high charge state for printing.

In the embodiments discussed above the first drop 36 and the second drop 35 of drop pair 34 have substantially the same volume. The formation of a drop pair 34 or a large drop 49 occurs with a drop pair period $T_p=2T_o$. This enables efficient drop formation and the capability to print at the highest speeds. In other embodiments the volumes of the first and second drops of the drop pairs may be different and the drop pair period $T_p$ of formation of a drop pair 34 or a large drop 49, is greater than $2T_o$ where $T_o$ defines the period of smaller of the two drops in the drop pair. As examples the first and second drops of the drop pair may have a ratio of their volumes of 4/3 or 3/2 corresponding to drop pair periods $T_p$ of $7T_o/3$ or $5T_o/3$. The size of the smallest drop is determined by the Rayleigh cutoff frequency $F_R$. In such embodiments the period of the charge electrode waveform will be equal to the drop pair period of formation of a drop pair 34 or large drop 49.

Figure 11A:
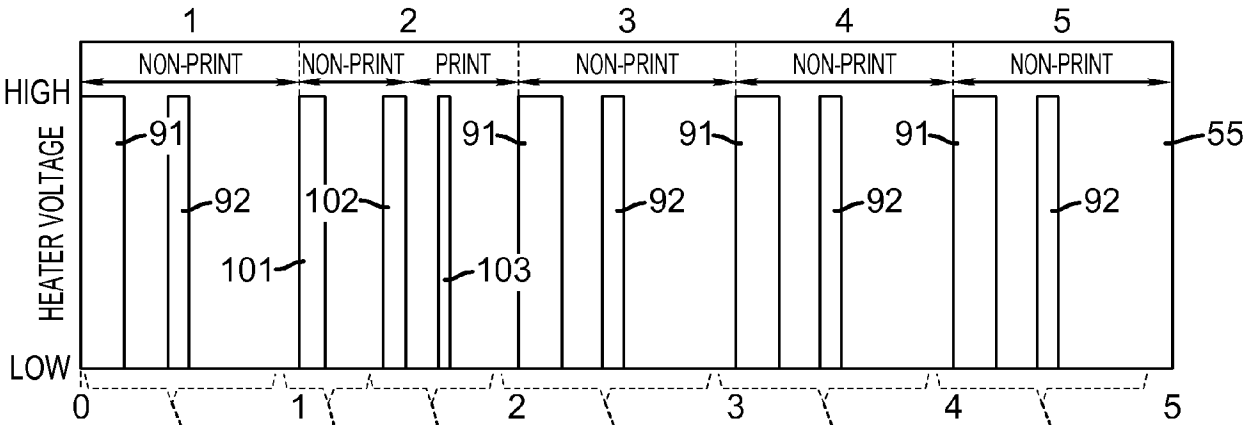
FIG. 11 shows a second example embodiment of a timing diagram illustrating drop formation pulses, the charge electrode waveform, and the break off timing of drops.
Figure 11B:
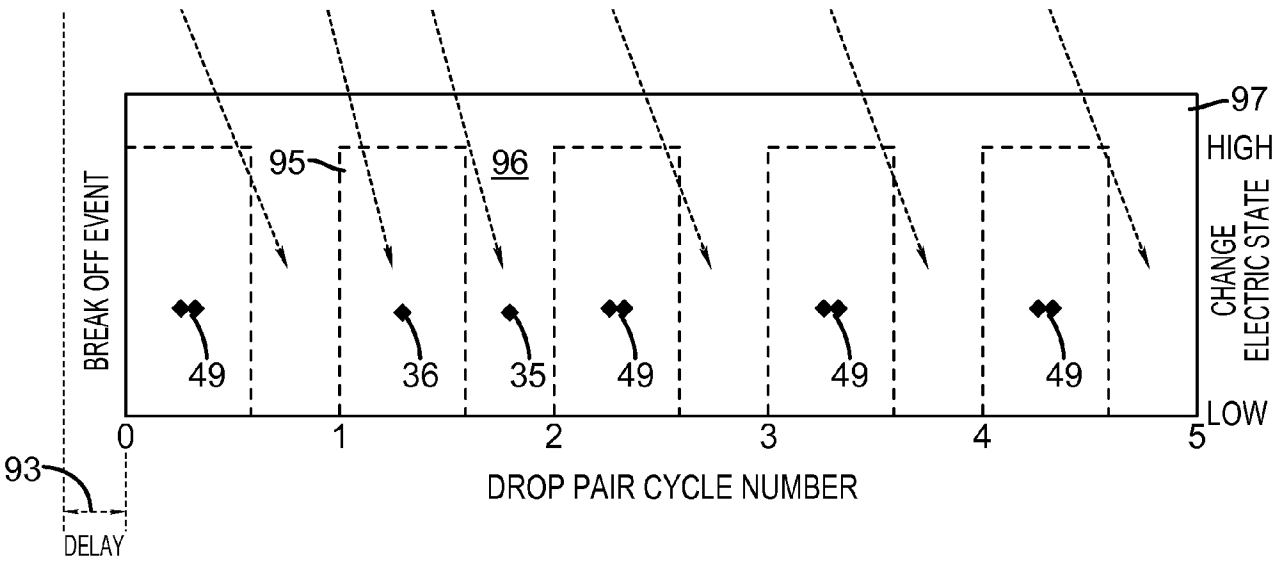

FIG. 11 illustrates such an embodiment in which the first and second drops in the drop pair do not have the same volume. As with FIG. 10, the time axis is marked out in drop pair cycles or periods. Each non-print drop cycle includes a first drop forming pulse 91 and a second drop forming pulse 92. The time between the first and second drop forming pulse 91 and 92 within a drop pair cycle is less than the time between the second drop forming pulse and the first drop forming pulse of the subsequent drop pair cycle. As a result the first drop of the drop pair is larger than the second drop of the drop pair. The non-uniform time between the first and second drop forming pulses can produce a velocity difference between the first and second drops of the drop pair. With such a velocity difference, the first and second drops of the drop pair can merge to form a large drop 49 without the use of a velocity modulation pulse. The drops which form large drop 49 break off close together in time (similar to that shown in FIG. 7C), during the first voltage state 95 of the charge electrode waveform 97. A different drop formation waveform made of pulses 101, 102 and 103 is used to create a print drop in the second drop pair cycle. The waveform for the second drop pair cycle is selected to cause the first drop 36 to break off during the first voltage state 95 and the second drop 35 to break off during the second voltage state 96 of the charge electrode waveform 97 and to prevent drops 35 and 36 from merging. In some embodiments, the timing of waveform pulses 101 and 102 can be the same as waveform pulses 91 and 92. Pulse 103 delays the break off of the second drop of the drop pair and prevents the drops of the second drop pair cycle from merging, thus allowing second drop in the drop pair to be printed.

Similarly, in the embodiments discussed previously, a charge electrode waveform with two voltage states, each active for half of the total period is used. In other embodiments, other charge electrode waveform with a period equal to the drop pair period for forming of drop pairs 34 or large drops 49 may be used. An illustration of this is shown in FIG. 11 where waveform 97 has two charge states that are active for different periods of time during the drop pair cycle.

Generally this invention can be practiced to create print drops in the range of 1-100 pl, with nozzle diameters in the range of 5-50 μm, depending on the resolution requirements for the printed image. The jet velocity is preferably in the range of 10-30 m/s. The fundamental drop generation frequency is preferably in the range of 50-1000 kHz.

The invention allows drops to be selected for printing or non-printing without the need for a separate charge electrode to be used for each liquid jet in an array of liquid jets as found in conventional electrostatic deflection based ink jet printers. Instead a single common charge electrode is utilized to charge drops from the liquid jets in an array. This eliminates the need to critically align each of the charge electrodes with the nozzles. Crosstalk charging of drops from one liquid jet by means of a charging electrode associated with a different liquid jet is not an issue. Since crosstalk charging is not an issue, it is not necessary to minimize the distance between the charge electrodes and the liquid jets as is required for traditional drop charging systems. The common charge electrode also offers improved charging and deflection efficiency thereby allowing a larger separation distance between the jets and the electrode. Distances between the charge electrode and the jet axis in the range of 25-300 μm are useable. The elimination of the individual charge electrode for each liquid jet also allows for higher densities of nozzles than traditional electrostatic deflection continuous inkjet system, which require separate charge electrodes for each nozzle. The nozzle array density can be in the range of 75 nozzles per inch (npi) to 1200 npi.

Figure 12:
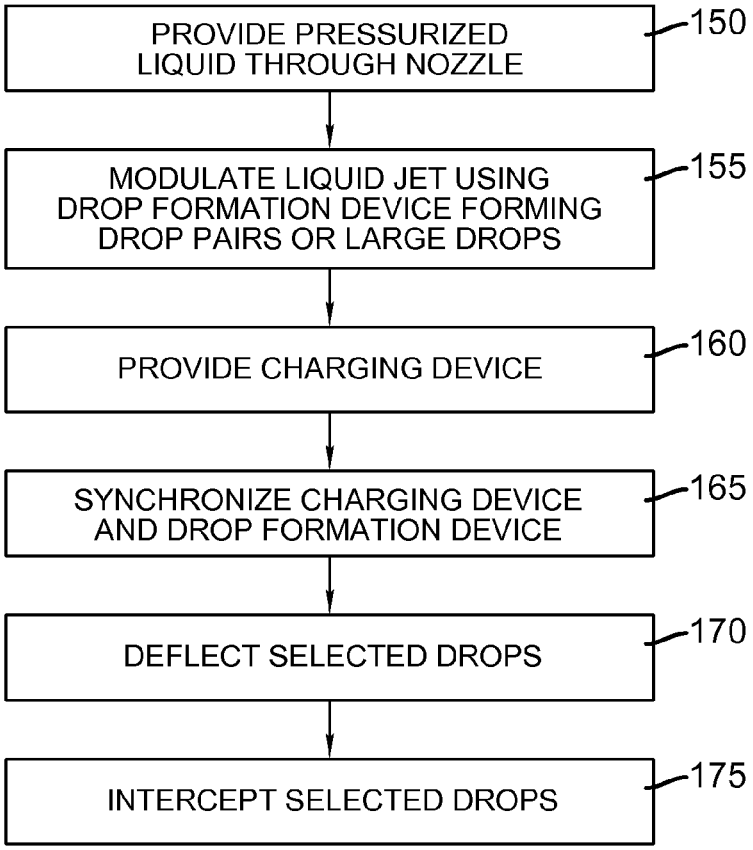
FIG. 12 is a block diagram of the method of drop ejection according to an embodiment of the invention.

Referring to FIG. 12, a method of ejecting liquid drops begins with step 150. In step 150, liquid is provided under a pressure that is sufficient to eject a liquid jet through a nozzle of a liquid chamber. Step 150 is followed by step 155.

In step 155, the liquid jet is modulated by supplying a drop formation device with a drop formation waveform to cause portions of the liquid jet to break off into a series of drops. The modulation selectively causes portions of the liquid jet to break off into drop pairs, including a first drop and a second drop, traveling along a path. Each drop pair is separated in time on average by a drop pair period. The modulation selectively causes other portions of the liquid jet to break off into one or more third drops traveling along the path separated on average by the same drop pair period, the third drop being larger than the first drop and the second drop. The selection of whether to form a drop pair of a first and a second drop or to form a large drop is based on the print data. Step 155 is followed by step 160.

In step 160, a charging device is provided. The charging device includes a charge electrode and a source of varying electrical potential. The charge electrode is associated with the liquid jet. The source of varying electrical potential varies the electrical potential between the charge electrode and the liquid jet by providing a waveform to the charge electrode. The waveform includes a period that is equal to the drop pair period of formation of the drop pairs or the third drops, a first distinct voltage state, and a second distinct voltage state. The waveform to the charge electrode is not dependent on the print data. Step 160 is followed by step 165.

In step 165, the charging device and the drop formation device are synchronized to produce a first charge to mass ratio on the first drop, produce a second charge to mass ratio on the second drop, and produce a third charge to mass ratio on the third drop, the third charge to mass ratio being substantially the same as one of the first charge to mass ratio and the second charge to mass ratio. Step 165 is followed by step 170.

In step 170, a deflection device is used to cause the first drop having the first charge to mass ratio to travel along a first path, the second drop having the second charge to mass ratio to travel to travel along a second path, and the third drop having a third charge to mass ratio to travel to travel along a third path; the third path being substantially the same as one of the first path and the second path. Step 170 is followed by step 175.

In step 175, a catcher is used to intercept drops traveling along one of the first path or the second path. The catcher is also used to intercept drops traveling along the third path.

It is to be noted that the waveform supplied to the drop formation device in step 155 depends on the image data, while the waveform supplied to the charge electrode in step 160 is independent of the image data.

The invention has been described in detail with particular reference to certain example embodiments thereof, but it will be understood that variations and modifications can be effected within the scope of the invention.

PARTS LIST

10 Continuous Inkjet Printing System
11 Ink Reservoir
12 Printhead or Liquid Ejector
13 Image Source
14 Deflection Mechanism
15 Ink Recycling Unit
16 Image Processor
17 Logic Controller
18 Stimulation controller
19 Recording Medium
20 Ink Pressure Regulator
21 Media Transport Controller
22 Transport Rollers
24 Liquid Chamber
26 Charged Drop Gutter Contact point
27 Charged Combined Drop Gutter Contact point
30 Gutter Ledge
31 Drop Merge Location
32 Break off Location
34 Drop Pair
35 Second Drop of Drop Pair
36 First Drop of Drop Pair
37 Second Path
38 First Path
39 Third Path
40 Continuous Liquid Ejection System
42 Drop Formation Device Transducer
43 Liquid Jet
44 Charge electrode
**44*a*** Second Charge Electrode
45 Charge Electrode
**45*a*** Second Charge Electrode
46 Printed Ink Drop
47 Catcher
48 Ink Film
49 Large Drops
50 Nozzle
51 Charging Voltage Source
52 Catcher Face
53 Deflection Electrode
54 Third Alternate Path
55 Stimulation Waveform
56 Stimulation Waveform Source
57 Catcher Bottom Plate
58 Ink Recovery Channel
59 Stimulation Transducer
60 Stimulation Device
61 Air Plenum
62 Insulating Adhesive
**62*a*** Second Insulating Adhesive
63 Deflection Electrode
64 Insulating Adhesive
**64*a*** Second Insulating Adhesive
65 Arrow indicating air flow direction
66 Gap
67 Catcher
68 Insulator
**68*a*** Insulator
69 Insulator
70 Grounded Conductor
71 Insulator
72 Insulator
73 Insulator
74 Deflection Electrode
75 Grounded Conductor
81 Drop Time Lapse Sequence Indicator
83 Charging Device
87 Liquid Jet Central Axis
89 Drop Formation Device
91 First drop forming pulse
92 Second drop forming pulse
93 Phase Delay Time
94 Large Drop Forming Pulse
95 First Voltage State
96 Second Voltage State
97 Charge Electrode Waveform
98 Print Drop Forming Pulse
99 Non-print Drop Forming Pulse
101 First Pulse of Print Drop Forming Waveform
102 Second Pulse of Print Drop Forming Waveform
103 Third Pulse of Print Drop Forming Waveform
150 Provide pressurized liquid through nozzle step
155 Modulate liquid jet using drop formation device step
160 Provide charging device step
165 Synchronize charging device and drop formation device step
170 Deflects drops step
175 Intercept selected drops step

The invention claimed is:

1. A continuous liquid ejection system comprising:

a liquid chamber in fluidic communication with a nozzle, the liquid chamber containing liquid under pressure sufficient to eject a liquid jet through the nozzle;

a drop formation device associated with the liquid jet, the drop forming device being operable to produce a modulation in the liquid jet to selectively cause portions of the liquid jet to break off into one or more pairs of drops traveling along a path, each drop pair separated on average by a drop pair period, each drop pair including a first drop and a second drop, the drop formation device also being operable to produce a modulation in the liquid jet to selectively cause portions of the liquid jet to break off into one or more third drops traveling along the path separated on average by the same drop pair period, the third drop being larger than the first drop and the second drop;

a charging device including:

a charge electrode associated with the liquid jet; and a source of varying electrical potential between the charge electrode and the liquid jet, the source of varying electrical potential providing a waveform, the waveform including a period that is equal to the drop pair period of formation of the drop pairs or the third drops, the waveform including a first distinct voltage state and a second distinct voltage state, the charging device being synchronized with the drop formation device to produce a first charge to mass ratio on the first drop of the drop pair, a second charge to mass ratio on the second drop of the drop pair, and a third charge to mass ratio on the third drop, the third charge to mass ratio being substantially the same as the first charge to mass ratio; and a deflection device that causes the first drop of the drop pair having the first charge to mass ratio to travel along a first path and causes the second drop of the drop pair having the second charge to mass ratio to travel along a second path, and causes the third drop having a third charge to mass ratio to travel along a third path.

2. The system of claim 1, further comprising:

a catcher positioned to intercept drops traveling along the third path and to intercept drops traveling along the first path.

3. The system of claim 1, wherein the third path is substantially the same as the first path.

4. The system of claim 1, wherein the liquid includes ink for printing on a recording medium.

5. The system of claim 1, the nozzle being one of an array of nozzles, and the charge electrode of the charging device being an electrode common to and associated with each of the liquid jets being ejected from the nozzles of the nozzle array.

6. The system of claim 1, wherein the first drop and the second drop have substantially the same volume.

7. The system of claim 1, wherein the third drop has a volume substantially equal to the sum of the volumes of the first drop and the second drop.

8. The system of claim 1, wherein the drop formation device further comprises:

a drop formation transducer associated with one of the liquid chamber, the nozzle, and the liquid jet; and a drop formation waveform source that supplies a drop formation waveform to the drop formation transducer.

9. The system of claim 8, wherein the drop formation transducer is one of a thermal device, a piezoelectric device, a MEMS actuator, an electrohydrodynamic device, an optical device, an electrostrictive device, and combinations thereof.

10. The system of claim 8, wherein the drop formation waveform supplied to the drop formation transducer can modulate at least one of liquid jet break off phase, drop velocity, and drop volume.

11. The system of claim 8, wherein the drop formation waveform supplied to the drop formation transducer is responsive to print data supplied by a stimulation controller.

12. The system of claim 8, wherein the drop formation waveform includes a first portion that creates the first drop of the drop pair and a second portion that creates the second drop of the drop pair.

13. The system of claim 1, wherein one of the first drop and the second drop is uncharged relative to the charge associated with the other of the first drop and the second drop.

14. The system of claim 1, wherein the source of varying electrical potential between the charge electrode and the liquid jet is not responsive to print data supplied by a stimulation controller.

15. The system of claim 1, wherein the source of varying electrical potential between the charge electrode and the liquid jet produces a waveform in which the first distinct voltage state and the second distinct voltage state are each active for a time interval equal to half of the drop pair period.

16. The system of claim 1, wherein the charge electrode is placed adjacent to the break off location of the liquid jets.

17. The system of claim 1, wherein the deflection device further comprises at least one deflection electrode to deflect charged drops, the at least one deflection electrode being in electrical communication with one of a source of electrical potential and ground.

18. The system of claim 1, wherein the charging device comprises a charge electrode including a first portion positioned on a first side of the liquid jet and a second portion positioned on a second side of the liquid jet.

19. The system of claim 1, wherein the deflection device further comprises a deflection electrode in electrical communication with a source of electrical potential that creates a drop deflection field to deflect charged drops.

20. The system of claim 1, wherein the first drop and the second drop are separated on average by a fundamental period and drop pair period is twice the fundamental period.

21. The system of claim 1, wherein the second distinct voltage state includes a DC offset.

* * * * *